US008121833B2

(12) United States Patent
Tammi et al.

(10) Patent No.: US 8,121,833 B2
(45) **Date of Patent: *Feb. 21, 2012**

(54) SIGNAL MODIFICATION METHOD FOR EFFICIENT CODING OF SPEECH SIGNALS

(75) Inventors: Mikko Tammi, Tampere (FI); Milan Jelinek, North Hatley (CA); Claude LaFlamme, Orford (CA); Vesa Ruoppila, Montréal (CA)

(73) Assignee: Nokia Corporation, Espoo (FI)

( * ) Notice: Subject to any disclaimer, the term of this patent is extended or adjusted under 35 U.S.C. 154(b) by 478 days.

This patent is subject to a terminal disclaimer.

(21) Appl. No.: 12/288,592

(22) Filed: Oct. 21, 2008

(65) Prior Publication Data

US 2009/0063139 A1 Mar. 5, 2009

Related U.S. Application Data

(62) Division of application No. 10/498,254, filed as application No. PCT/CA02/01948 on Dec. 13, 2002, now Pat. No. 7,680,651.

(51) Int. Cl.
*G10L 19/00* (2006.01)

(52) U.S. Cl. ..... 704/219; 704/207; 704/208; 704/241; 704/262

(58) Field of Classification Search ..... None
See application file for complete search history.

(56) References Cited

U.S. PATENT DOCUMENTS 5,704,003 A * 12/1997 Kleijn et al. ..... 395/2.29
5,974,377 A * 10/1999 Navarro et al. ..... 704/220
6,223,151 B1 * 4/2001 Kleijn et al. ..... 704/207
6,449,590 B1 * 9/2002 Gao ..... 704/219
2001/0023395 A1 * 9/2001 Su et al. ..... 704/220

FOREIGN PATENT DOCUMENTS

EP 0602826 A2 * 6/1994
WO WO-00/11653 A1 * 3/2000
WO WO-00/11654 A1 * 3/2000

OTHER PUBLICATIONS

Chui, S. P. et al., "Low Delay CELP Coding at 8kbps Using Classified Voiced and Unvoiced Excitation Codebooks"; 1994 IEEE; ISSIPNN'94; 0-7803-1865-X/94; pp. 472-475.*

W. Bastiaan Kleijn et al.; "Interpolation of the Pitch-Predictor Parameters in Analysis-by-Synthesis Speech Coders"; 1994 IEEE; IEEE Transactions on Speech and Audio Processing, vol. 2, No. 1, Part 1; 1063-6676/94; pp. 42-54.*

W. Bastiaan Kleijn et al.; "The RCELP Speech-Coding Algorithm"; ETT, vol. 5, No. 5; Sep. to Oct. 1994; pp. 39-48.*

(Continued)

*Primary Examiner* — Leonard Saint Cyr
(74) *Attorney, Agent, or Firm* — Harrington & Smith

(57) ABSTRACT

The exemplary embodiments of the invention provide at least a method and an apparatus to perform operations including dividing a sound signal into a series of successive frames, dividing each frame into a number of subframes, producing a residual signal by filtering the sound signal through a linear prediction analysis filter, locating a last pitch pulse of the sound signal of a previous frame from the residual signal, extracting a pitch pulse prototype of given length around a position of the last pitch pulse of the previous frame using the residual signal, and locating pitch pulses in a current frame using the pitch pulse prototype.

12 Claims, 13 Drawing Sheets

OTHER PUBLICATIONS

Yang Gao et al.; "eX-CELP: A Speech Coding Paradigm"; Conexant Systems, Inc.*

B. Bessette et al.; "Techniques for High-Quality ACELP Coding of Wideband Speech"; Eurospeech 2001-Scandinavia; pp. 1997-2000.*

Tammi, M. et al., "Signal Modification for Voiced Wideband Speech Coding and Its Application for IS-95 System"; 2002 IEEE; 0-7803-7549-1/02; pp. 35-37.*

GSM 3GPP TS 26.190 V5.1.0 (Dec. 2001); "Speech Codec Speech Processing Functions; AMR Wideband Speech Codec; Transcoding Functions" (Release 5).*

GSM 3GPP TS 26.192 V5.0.0 (Mar. 2001); "Speech Codec Speech Processing Functions; AMR Wideband Speech Codec; Comfort Noise Aspects" (Release 5).

GSM 3GPP TS 26.193 V5.0.0 (Mar. 2001); "Speech Codec Speech Processing Functions; AMR Wideband Speech Codec; Source Controlled Rate Operation" (Release 5).

GSM 3GPP TS 26.194 V5.0.0 (Mar. 2001); "Speech Codec Speech Processing Functions; AMR Wideband Speech Codec; Voice Activity Detector (VAD)" (Release 5)'.

"Signal Modification for Voiced Wideband Speech Coding and its Application for IS-95 System", Mikko Tammi & Milan Jelinek, 2002 IEEE Proceedings Speech Coding Workshop, Oct. 6-9, 2002 pp. 35-37, XP002250153.

"Low Delay CELP Coding at 8kbps Using Classified Voiced and Unvoiced Excitation Codebooks", S.P. Chui and C.F. Chan, Proceedings of ICSIPNN '94. International Conference on Speech, Image Processing and Neural Networks (CAT. No. 94$^{TH}$0638-7), Apr. 13-16, 1994 pp. 472-475, vol. 2, XP002250152.

* cited by examiner

SIGNAL MODIFICATION METHOD FOR EFFICIENT CODING OF SPEECH SIGNALS

This application is a Divisional Application of U.S. patent application Ser. No. 10/498,254 filed on Nov. 17, 2004, now U.S. Pat. No. 7,680,651 which is the national phase of International (PCT) Patent Application Serial No. PCT/CA02/01948, filed Dec. 13, 2002, published under PCT Article 21(2) in English, which claims priority to and the benefit of Canadian Patent Application No. 2,365,203, filed Dec. 14, 2001, the disclosures of which are incorporated herein by reference.

FIELD OF THE INVENTION

The present invention relates generally to the encoding and decoding of sound signals in communication systems. More specifically, the present invention is concerned with a signal modification technique applicable to, in particular but not exclusively, code-excited linear prediction (CELP) coding.

BACKGROUND OF THE INVENTION

Demand for efficient digital narrow- and wideband speech coding techniques with a good trade-off between the subjective quality and bit rate is increasing in various application areas such as teleconferencing, multimedia, and wireless communications. Until recently, the telephone bandwidth constrained into a range of 200-3400 Hz has mainly been used in speech coding applications. However, wideband speech applications provide increased intelligibility and naturalness in communication compared to the conventional telephone bandwidth. A bandwidth in the range 50-7000 Hz has been found sufficient for delivering a good quality giving an impression of face-to-face communication. For general audio signals, this bandwidth gives an acceptable subjective quality, but is still lower than the quality of FM radio or CD that operate in ranges of 20-16000 Hz and 20-20000 Hz, respectively.

A speech encoder converts a speech signal into a digital bit stream which is transmitted over a communication channel or stored in a storage medium. The speech signal is digitized, that is sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a sound signal.

Code-Excited Linear Prediction (CELP) coding is one of the best techniques for achieving a good compromise between the subjective quality and bit rate. This coding technique is a basis of several speech coding standards both in wireless and wire line applications. In CELP coding, the sampled speech signal is processed in successive blocks of N samples usually called frames, where N is a predetermined number corresponding typically to 10-30 ms. A linear prediction (LP) filter is computed and transmitted every frame. The computation of the LP filter typically needs a look ahead, i.e. a 5-10 ms speech segment from the subsequent frame. The N-sample frame is divided into smaller blocks called subframes. Usually the number of subframes is three or four resulting in 4-10 ms subframes. In each subframe, an excitation signal is usually obtained from two components: a past excitation and an innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

In conventional CELP coding, long term prediction for mapping the past excitation to the present is usually performed on a subframe basis. Long term prediction is characterized by a delay parameter and a pitch gain that are usually computed, coded and transmitted to the decoder for every subframe. At low bit rates, these parameters consume a substantial proportion of the available bit budget. Signal modification techniques [1-7]

[1] W. B. Kleijn, P. Kroon, and D. Nahumi, "The RCELP speech-coding algorithm," European Transactions on Telecommunications, Vol. 4, No. 5, pp. 573-582, 1994.

[2] W. B. Kleijn, R. P. Ramachandran, and P. Kroon, "Interpolation of the pitch-predictor parameters in analysis-by-synthesis speech coders," IEEE Transactions on Speech and Audio Processing, Vol. 2, No. 1, pp. 42-54, 1994.

[3] Y. Gao, A. Benyassine, J. Thyssen, H. Su, and E. Shlomot, "EX-CELP: A speech coding paradigm," IEEE International Conference on Acoustics, Speech and Signal Processing (ICASSP), Salt Lake City, Utah, U.S.A., pp. 689-692, 7-11 May 2001.

[4] U.S. Pat. No. 5,704,003, "RCELP coder," Lucent Technologies Inc., (W. B. Kleijn and D. Nahumi), Filing Date: 19 Sep. 1995.

[5] European Patent Application 0 602 826 A2, "Time shifting for analysis-by-synthesis coding," AT&T Corp., (B. Kleijn), Filing Date: 1 Dec. 1993.

[6] Patent Application WO 00/11653, "Speech encoder with continuous warping combined with long term prediction," Conexant Systems Inc., (Y. Gao), Filing Date: 24 Aug. 1999.

[7] Patent Application WO 00/11654, "Speech encoder adaptively applying pitch preprocessing with continuous warping," Conexant Systems Inc., (H. Su and Y. Gao), Filing Date: 24 Aug. 1999.

improve the performance of long term prediction at low bit rates by adjusting the signal to be coded. This is done by adapting the evolution of the pitch cycles in the speech signal to fit the long term prediction delay, enabling to transmit only one delay parameter per frame. Signal modification is based on the premise that it is possible to render the difference between the modified speech signal and the original speech signal inaudible. The CELP coders utilizing signal modification are often referred to as generalized analysis-by-synthesis or relaxed CELP (RCELP) coders.

Signal modification techniques adjust the pitch of the signal to a predetermined delay contour. Long term prediction then maps the past excitation signal to the present subframe using this delay contour and scaling by a gain parameter. The delay contour is obtained straightforwardly by interpolating between two open-loop pitch estimates, the first obtained in the previous frame and the second in the current frame. Interpolation gives a delay value for every time instant of the frame. After the delay contour is available, the pitch in the subframe to be coded currently is adjusted to follow this artificial contour by warping, i.e. changing the time scale of the signal.

In discontinuous warping [1, 4 and 5]

[1] W. B. Kleijn, P. Kroon, and D. Nahumi, "The RCELP speech-coding algorithm," European Transactions on Telecommunications, Vol. 4, No. 5, pp. 573-582, 1994.

[4] U.S. Pat. No. 5,704,003, "RCELP coder," Lucent Technologies Inc., (W. B. Kleijn and D. Nahumi), Filing Date: 19 Sep. 1995.

[5] European Patent Application 0 602 826 A2, "Time shifting for analysis-by-synthesis coding," AT&T Corp., (B. Kleijn), Filing Date: 1 Dec. 1993.

a signal segment is shifted in time without altering the segment length. Discontinuous warping requires a procedure for handling the resulting overlapping or missing signal portions. Continuous warping [2, 3, 6, 7]

[2] W. B. Kleijn, R. P. Ramachandran, and P. Kroon, "Interpolation of the pitch-predictor parameters in analysis-by-synthesis speech coders," IEEE Transactions on Speech and Audio Processing, Vol. 2, No. 1, pp. 42-54, 1994.

[3] Y. Gao, A. Benyassine, J. Thyssen, H. Su, and E. Shlomot, "EX-CELP: A speech coding paradigm," IEEE International Conference on Acoustics, Speech and Signal Processing (ICASSP), Salt Lake City, Utah, U.S.A., pp. 689-692, 7-11 May 2001.

[6] Patent Application WO 00/11653, "Speech encoder with continuous warping combined with long term prediction," Conexant Systems Inc., (Y. Gao), Filing Date: 24 Aug. 1999.

[7] Patent Application WO 00/11654, "Speech encoder adaptively applying pitch preprocessing with continuous warping," Conexant Systems Inc., (H. Su and Y. Gao), Filing Date 24 Aug. 1999.

either contracts or expands a signal segment. This is done using a time continuous approximation for the signal segment and re-sampling it to a desired length with unequal sampling intervals determined based on the delay contour. For reducing artifacts in these operations, the tolerated change in the time scale is kept small. Moreover, warping is typically done using the LP residual signal or the weighted speech signal to reduce the resulting distortions. The use of these signals instead of the speech signal also facilitates detection of pitch pulses and low-power regions in between them, and thus the determination of the signal segments for warping. The actual modified speech signal is generated by inverse filtering.

After the signal modification is done for the current subframe, the coding can proceed in any conventional manner except the adaptive codebook excitation is generated using the predetermined delay contour. Essentially the same signal modification techniques can be used both in narrow- and wideband CELP coding.

Signal modification techniques can also be applied in other types of speech coding methods such as waveform interpolation coding and sinusoidal coding for instance in accordance with [8].

[8] U.S. Pat. No. 6,223,151, "Method and apparatus for preprocessing speech signals prior to coding by transform-based speech coders," Telefon Aktie Bolaget L M Ericsson, (W. B. Kleijn and T. Eriksson), Filing Date 10 Feb. 1999.

SUMMARY OF THE INVENTION

The present invention relates to a method for determining a long-term-prediction delay parameter characterizing a long term prediction in a technique using signal modification for digitally encoding a sound signal, comprising dividing the sound signal into a series of successive frames, locating a feature of the sound signal in a previous frame, locating a corresponding feature of the sound signal in a current frame, and determining the long-term-prediction delay parameter for the current frame such that the long term prediction maps the signal feature of the previous frame to the corresponding signal feature of the current frame.

The subject invention is concerned with a device for determining a long-term-prediction delay parameter characterizing a long term prediction in a technique using signal modification for digitally encoding a sound signal, comprising a divider of the sound signal into a series of successive frames, a detector of a feature of the sound signal in a previous frame, a detector of a corresponding feature of the sound signal in a current frame, and a calculator of the long-term-prediction delay parameter for the current frame, the calculation of the long-term-prediction delay parameter being made such that the long term prediction maps the signal feature of the previous frame to the corresponding signal feature of the current frame.

According to the invention, there is provided a signal modification method for implementation into a technique for digitally encoding a sound signal, comprising dividing the sound signal into a series of successive frames, partitioning each frame of the sound signal info a plurality of signal segments, and warping at least a part of the signal segments of the frame, this warping comprising constraining the warped signal segments inside the frame.

In accordance with the present invention, there is provided a signal modification device for implementation into a technique for digitally encoding a sound signal, comprising a first divider of the sound signal into a series of successive frames, a second divider of each frame of the sound signal into a plurality of signal segments, and a signal segment warping member supplied with at least a part of the signal segments of the frame, this warping member comprising a constrainer of the warped signal segments inside the frame.

The present invention also relates to a method for searching pitch pulses in a sound signal, comprising dividing the sound signal into a series of successive frames, dividing each frame into a number of subframes, producing a residual signal by filtering the sound signal through a linear prediction analysis filter, locating a last pitch pulse of the sound signal of the previous frame from the residual signal, extracting a pitch pulse prototype of given length around the position of the last pitch pulse of the previous frame using the residual signal, and locating pitch pulses in a current frame using the pitch pulse prototype.

The present invention is also concerned with a device for searching pitch pulses in a sound signal, comprising a divider of the sound signal into a series of successive frames, a divider of each frame into a number of subframes, a linear prediction analysis filter for filtering the sound signal and thereby producing a residual signal, a detector of a last pitch pulse of the sound signal of the previous frame in response to the residual signal, an extractor of a pitch pulse prototype of given length around the position of the last pitch pulse of the previous frame in response to the residual signal, and a detector of pitch pulses in a current frame using the pitch pulse prototype.

According to the invention, there is also provided a method for searching pitch pulses in a sound signal, comprising dividing the sound signal into a series of successive frames, dividing each frame into a number of subframes, producing a weighted sound signal by processing the sound signal through a weighting filter wherein the weighted sound signal is indicative of signal periodicity, locating a last pitch pulse of the sound signal of the previous frame from the weighted sound signal, extracting a pitch pulse prototype of given length around the position of the last pitch pulse of the previous frame using the weighted sound signal, and locating pitch pulses in a current frame using the pitch pulse prototype.

Also in accordance with the present invention, there is provided a device for searching pitch pulses in a sound signal, comprising a divider of the sound signal into a series of successive frames, a divider of each frame into a number of subframes, a weighting filter for processing the sound signal to produce a weighted sound signal wherein the weighted sound signal is indicative of signal periodicity, a detector of a last pitch pulse of the sound signal of the previous frame in response to the weighted sound signal, an extractor of a pitch pulse prototype of given length around the position of the last pitch pulse of the previous frame in response to the weighted sound signal, and a detector of pitch pulses in a current frame using the pitch pulse prototype.

The present invention further relates to a method for searching pitch pulses in a sound signal, comprising dividing the sound signal into a series of successive frames, dividing each frame into a number of subframes, producing a synthesized weighted sound signal by filtering a synthesized speech signal produced during a last subframe of a previous frame of the sound signal through a weighting filter, locating a last pitch pulse of the sound signal of the previous frame from the synthesized weighted sound signal, extracting a pitch pulse prototype of given length around the position of the last pitch pulse of the previous frame using the synthesized weighted sound signal, and locating pitch pulses in a current frame using the pitch pulse prototype.

The present invention is further concerned with a device for searching pitch pulses in a sound signal, comprising a divider of the sound signal into a series of successive frames, a divider of each frame into a number of subframes, a weighting filter for filtering a synthesized speech signal produced during a last subframe of a previous frame of the sound signal and thereby producing a synthesized weighted sound signal, a detector of a last pitch pulse of the sound signal of the previous frame in response to the synthesized weighted sound signal, an extractor of a pitch pulse prototype of given length around the position of the last pitch pulse of the previous frame in response to the synthesized weighted sound signal, and a detector of pitch pulses in a current frame using the pitch pulse prototype.

According to the invention, there is further provided a method for forming an adaptive codebook excitation during decoding of a sound signal divided into successive frames and previously encoded by means of a technique using signal modification for digitally encoding the sound signal, comprising:

receiving, for each frame, a long-term-prediction delay parameter characterizing a long term prediction in the digital sound signal encoding technique;

recovering a delay contour using the long-term-prediction delay parameter received during a current frame and the long-term-prediction delay parameter received during a previous frame, wherein the delay contour, with long term prediction, maps a signal feature of the previous frame to a corresponding signal feature of the current frame;

forming the adaptive codebook excitation in an adaptive codebook in response to the delay contour.

Further in accordance with the present invention, there is provided a device for forming an adaptive codebook excitation during decoding of a sound signal divided into successive frames and previously encoded by means of a technique using signal modification for digitally encoding the sound signal, comprising:

a receiver of a long-term-prediction delay parameter of each frame, wherein the long-term-prediction delay parameter characterizes a long term prediction in the digital sound signal encoding technique;

a calculator of a delay contour in response to the long-term-prediction delay parameter received during a current frame and the long-term-prediction delay parameter received during a previous frame, wherein the delay contour, with long term prediction, maps a signal feature of the previous frame to a corresponding signal feature of the current frame; and an adaptive codebook for forming the adaptive codebook excitation in response to the delay contour.

The foregoing and other objects, advantages and features of the present invention will become more apparent upon reading of the following non restrictive description of illustrative embodiments thereof, given by way of example only with reference to the accompanying drawings.

BRIEF DESCRIPTION OF THE DRAWINGS

FIG. 6 is an illustrative example of located pitch pulse positions and a corresponding pitch cycle segmentation for one frame;

DETAILED DESCRIPTION OF THE ILLUSTRATIVE EMBODIMENTS

Although the illustrative embodiments of the present invention will be described in relation to speech signals and the 3GPP AMR Wideband Speech Codec AMR-WB Standard (ITU-T G.722.2), it should be kept in mind that the concepts of the present invention may be applied to other types of sound signals as well as other speech and audio coders.

Figure 1:
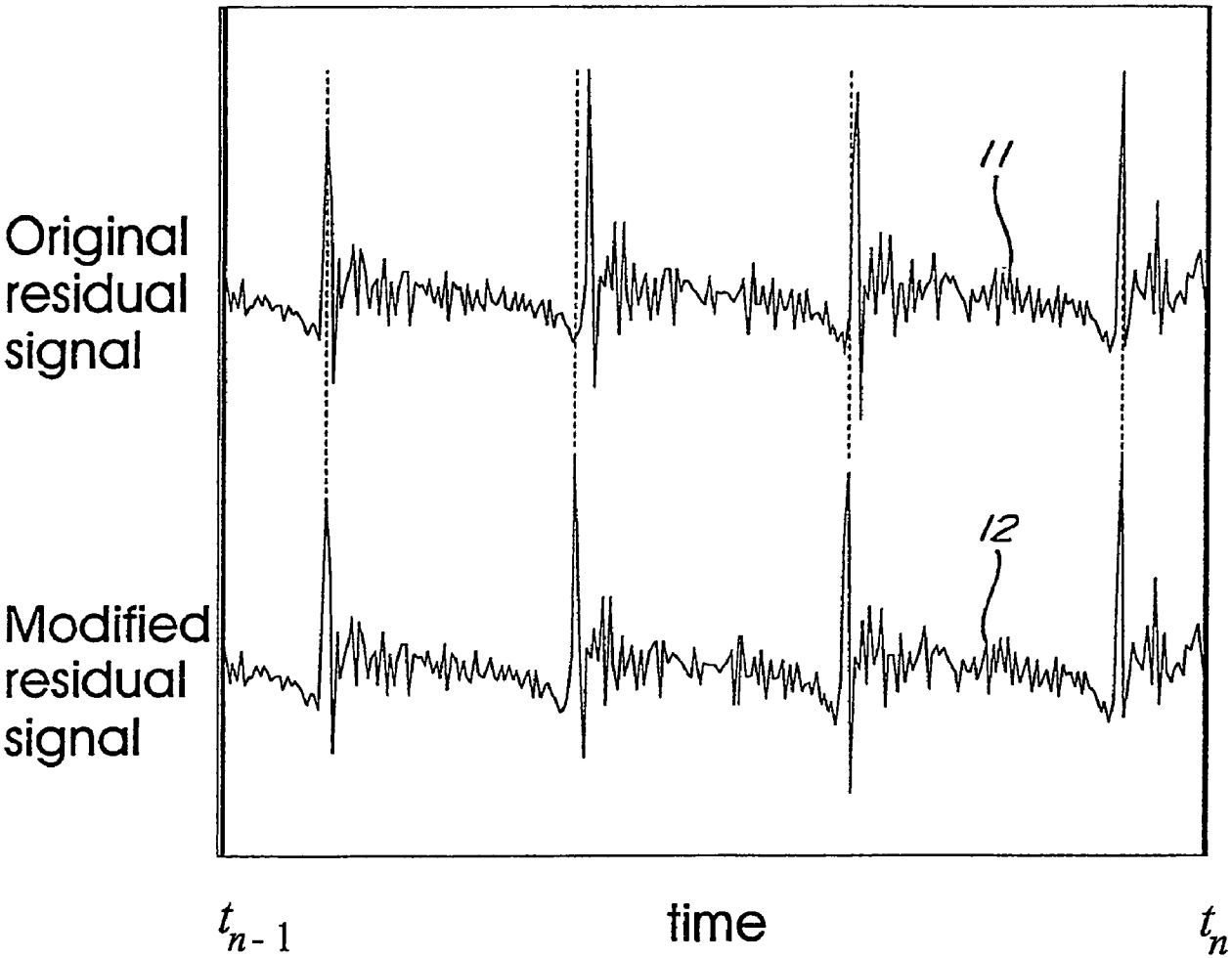
FIG. 1 is an illustrative example of original and modified residual signals for one frame.

FIG. 1 illustrates an example of modified residual signal 12 within one frame. As shown in FIG. 1, the time shift in the modified residual signal 12 is constrained such that this modified residual signal is time synchronous with the original, unmodified residual signal 11 at frame boundaries occurring at time instants $t_{n-1}$ and $t_n$. Here n refers to the index of the present frame.

More specifically, the time shift is controlled implicitly with a delay contour employed for interpolating the delay parameter over the current frame. The delay parameter and contour are determined considering the time alignment constrains at the above-mentioned frame boundaries. When linear interpolation is used to force the time alignment, the resulting delay parameters tend to oscillate over several frames. This often causes annoying artifacts to the modified signal whose pitch follows the artificial oscillating delay contour. Use of a properly chosen nonlinear interpolation technique for the delay parameter will substantially reduce these oscillations.

Figure 2:
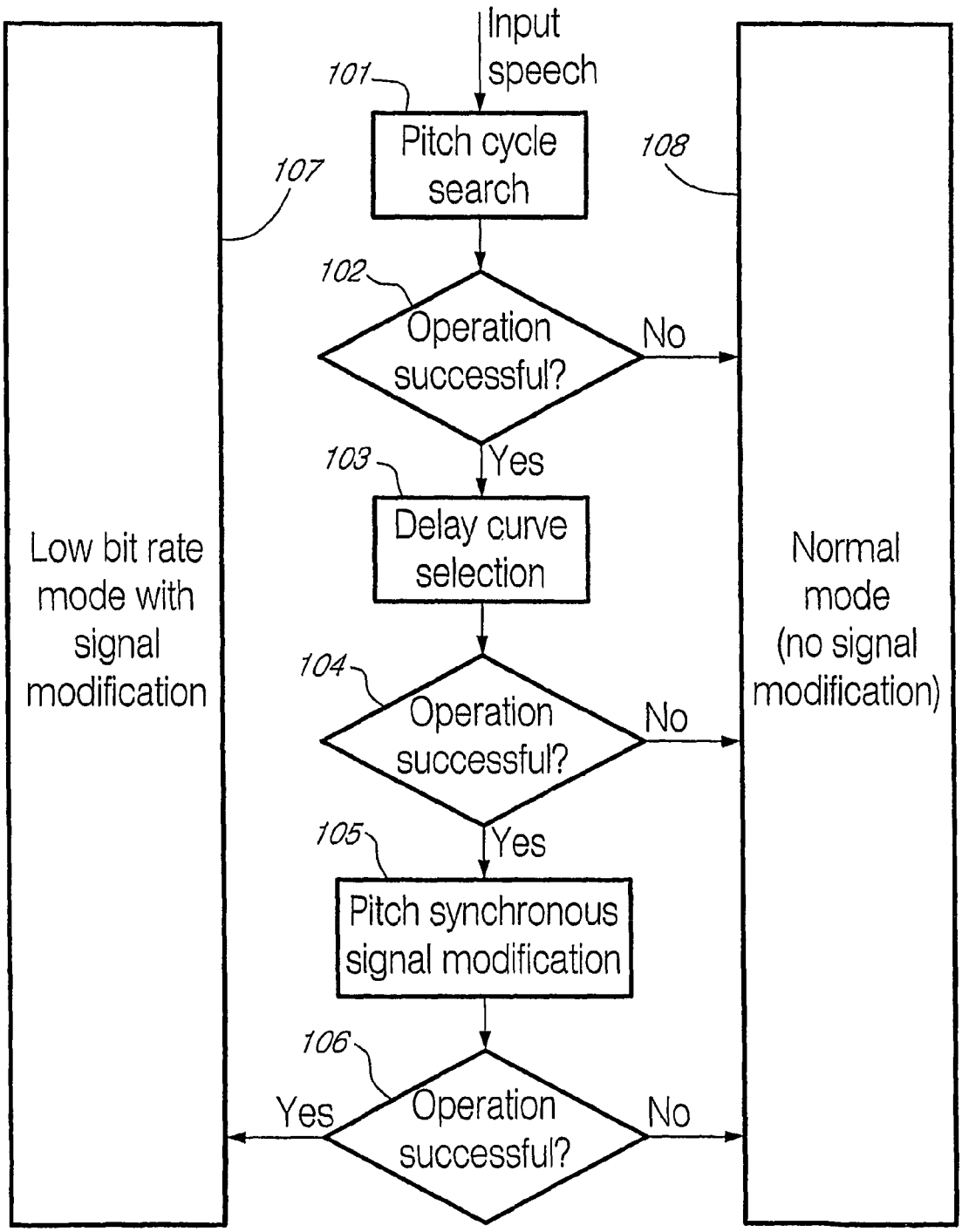
FIG. 2 is a functional block diagram of an illustrative embodiment of a signal modification method according to the invention.

A functional block diagram of the illustrative embodiment of the signal modification method according to the invention is presented in FIG. 2.

The method starts, in "pitch cycle search" block 101, by locating individual pitch pulses and pitch cycles. The search of block 101 utilizes an open-loop pitch estimate interpolated over the frame. Based on the located pitch pulses, the frame is divided into pitch cycle segments, each containing one pitch pulse and restricted inside the frame boundaries $t_{n-1}$ and $t_n$.

The function of the "delay curve selection" block 103 is to determine a delay parameter for the long term predictor and form a delay contour for interpolating this delay parameter over the frame. The delay parameter and contour are determined considering the time synchrony constrains at frame boundaries $t_{n-1}$ and $t_n$. The delay parameter determined in block 103 is coded and transmitted to the decoder when signal modification is enabled for the current frame.

The actual signal modification procedure is conducted in the "pitch synchronous signal modification" block 105. Block 105 first forms a target signal based on the delay contour determined in block 103 for subsequently matching the individual pitch cycle segments into this target signal. The pitch cycle segments are then shifted one by one to maximize their correlation with this target signal. To keep the complexity at a low level, no continuous time warping is applied while searching the optimal shift and shifting the segments.

The illustrative embodiment of signal modification method as disclosed in the present specification is typically enabled only on purely voiced speech frames. For instance, transition frames such as voiced onsets are not modified because of a high risk of causing artifacts. In purely voiced frames, pitch cycles usually change relatively slowly and therefore small shifts suffice to adapt the signal to the long term prediction model. Because only small, cautious signal adjustments are made, the probability of causing artifacts is minimized.

The signal modification method constitutes an efficient classifier for purely voiced segments, and hence a rate determination mechanism to be used in a source-controlled coding of speech signals. Every block 101, 103 and 105 of FIG. 2 provide several indicators on signal periodicity and the suitability of signal modification in the current frame. These indicators are analyzed in logic blocks 102, 104 and 106 in order to determine a proper coding mode and bit rate for the current frame. More specifically, these logic blocks 102, 104 and 106 monitor the success of the operations conducted in blocks 101, 103, and 105.

If block 102 detects that the operation performed in block 101 is successful, the signal modification method is continued in block 103. When this block 102 detects a failure in the operation performed in block 101, the signal modification procedure is terminated and the original speech frame is preserved intact for coding (see block 108 corresponding to normal mode (no signal modification)).

If block 104 detects that the operation performed in block 103 is successful, the signal modification method is continued in block 105. When, on the contrary, this block 104 detects a failure in the operation performed in block 103, the signal modification procedure is terminated and the original speech frame is preserved intact for coding (see block 108 corresponding to normal mode (no signal modification)).

If block 106 detects that the operation performed in block 105 is successful, a low bit rate mode with signal modification is used (see block 107). On the contrary, when this block 106 detects a failure in the operation performed in block 105 the signal modification procedure is terminated, and the original speech frame is preserved intact for coding (see block 108 corresponding to normal mode (no signal modification)). The operation of the blocks 101-108 will be described in detail later in the present specification.

Figure 3:
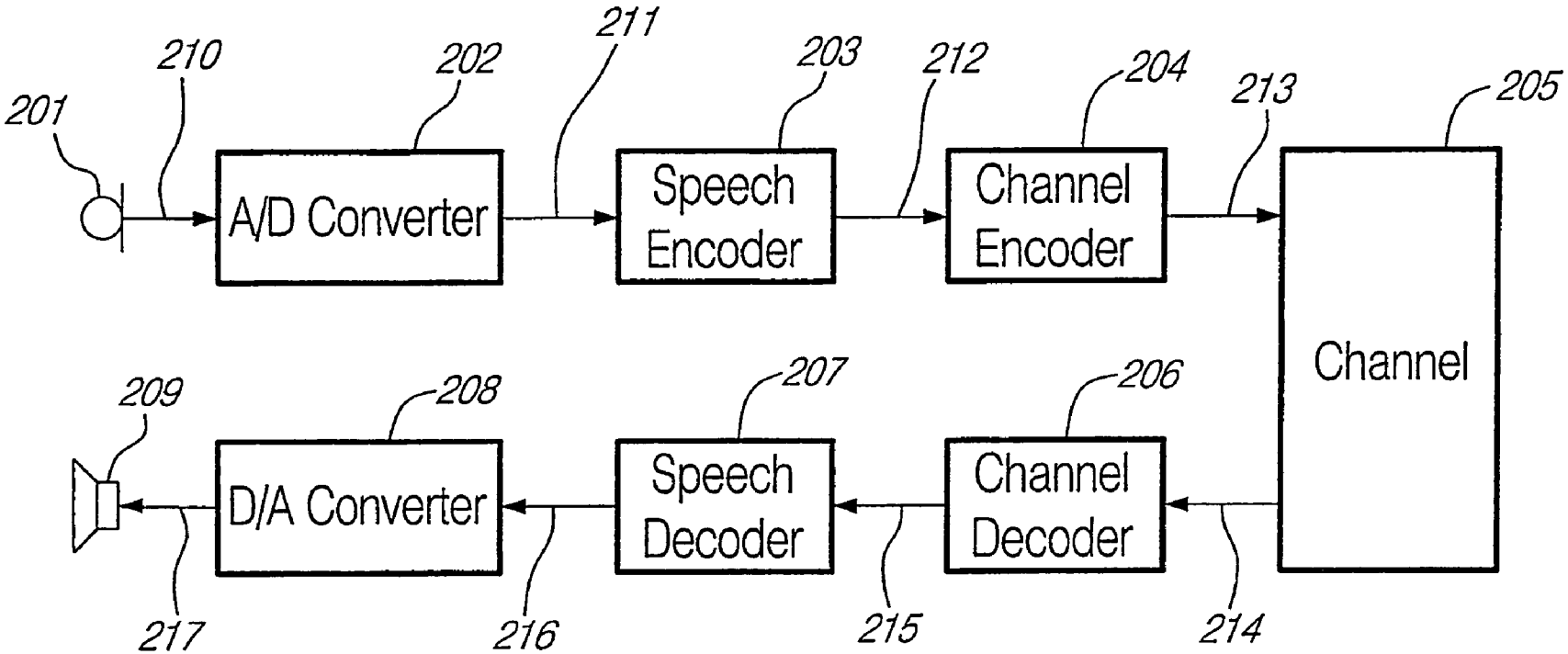
FIG. 3 is a schematic block diagram of an illustrative example of speech communication system showing the use of speech encoder and decoder.

FIG. 3 is a schematic block diagram of an illustrative example of speech communication system depicting the use of speech encoder and decoder. The speech communication system of FIG. 3 supports transmission and reproduction of a speech signal across a communication channel 205. Although it may comprise for example a wire, an optical link or a fiber link, the communication channel 205 typically comprises at least in part a radio frequency link. The radio frequency link often supports multiple, simultaneous speech communications requiring shared bandwidth resources such as may be found with cellular telephony. Although not shown, the communication channel 205 may be replaced by a storage device that records and stores the encoded speech signal for later playback.

On the transmitter side, a microphone 201 produces an analog speech signal 210 that is supplied to an analog-to-digital (A/D) converter 202. The function of the A/D converter 202 is to convert the analog speech signal 210 into a digital speech signal 211. A speech encoder 203 encodes the digital speech signal 211 to produce a set of coding parameters 212 that are coded into binary form and delivered to a channel encoder 204. The channel encoder 204 adds redundancy to the binary representation of the coding parameters before transmitting them into a bitstream 213 over the communication channel 205.

On the receiver side, a channel decoder 206 is supplied with the above mentioned redundant binary representation of the coding parameters from the received bitstream 214 to detect and correct channel errors that occurred in the transmission. A speech decoder 207 converts the channel-error-corrected bitstream 215 from the channel decoder 206 back to a set of coding parameters for creating a synthesized digital speech signal 216. The synthesized speech signal 216 reconstructed by the speech decoder 207 is converted to an analog speech signal 217 through a digital-to-analog (D/A) converter 208 and played back through a loudspeaker unit 209.

Figure 4:
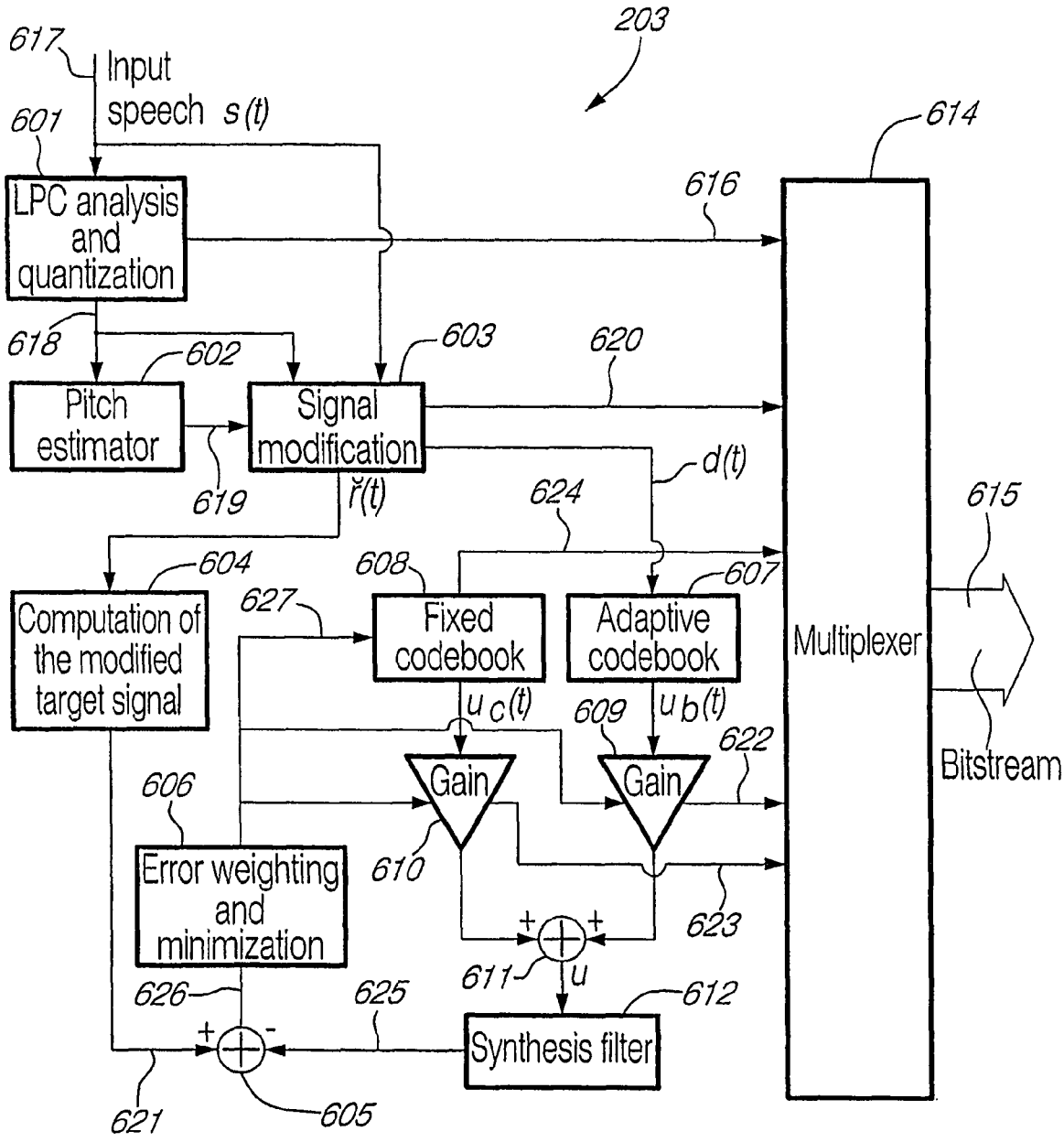
FIG. 4 is a schematic block diagram of an illustrative embodiment of speech encoder that utilizes a signal modification method.

FIG. 4 is a schematic block diagram showing the operations performed by the illustrative embodiment of speech encoder 203 (FIG. 3) incorporating the signal modification functionality. The present specification presents a novel implementation of this signal modification functionality of block 603 in FIG. 4. The other operations performed by the speech encoder 203 are well known to those of ordinary skill in the art and have been described, for example, in the publication [10]

[10] 3GPP TS 26.190, "AMR Wideband Speech Codec: Transcoding Functions," 3*GPP Technical Specification.* which is incorporated herein by reference. When not stated otherwise, the implementation of the speech encoding and decoding operations in the illustrative embodiments and examples of the present invention will comply with the AMR Wideband Speech Codec (AMR-WB) Standard.

The speech encoder 203 as shown in FIG. 4 encodes the digitized speech signal using one or a plurality of coding modes. When a plurality of coding modes are used and the signal modification functionality is disabled in one of these modes, this particular mode will operate in accordance with well established standards known to those of ordinary skill in the art.

Although not shown in FIG. 4, the speech signal is sampled at a rate of 16 kHz and each speech signal sample is digitized. The digital speech signal is then divided into successive frames of given length, and each of these frames is divided into a given number of successive subframes. The digital speech signal is further subjected to preprocessing as taught by the AMR-WB standard. This preprocessing includes high-pass filtering, pre-emphasis filtering using a filter $P(z)=1-0.68z^{-1}$ and down-sampling from the sampling rate of 16 kHz to 12.8 kHz. The subsequent operations of FIG. 4 assume that the input speech signal s(t) has been preprocessed and down-sampled to the sampling rate of 12.8 kHz.

The speech encoder 203 comprises an LP (Linear Prediction) analysis and quantization module 601 responsive to the input, preprocessed digital speech signal s(t) 617 to compute and quantize the parameters $a_0, a_1, a_2, \ldots, a_{nA}$ of the LP filter 1/A(z), wherein $n_A$ is the order of the filter and $A(z)=a_0+a_1z^{-1}+a_2z^{-2}+\ldots+a_{nA}z^{-nA}$. The binary representation 616 of these quantized LP filter parameters is supplied to the multiplexer 614 and subsequently multiplexed into the bitstream 615. The non-quantized and quantized LP filter parameters can be interpolated for obtaining the corresponding LP filter parameters for every subframe.

The speech encoder 203 further comprises a pitch estimator 602 to compute open-loop pitch estimates 619 for the current frame in response to the LP filter parameters 618 from the LP analysis and quantization module 601. These open-loop pitch estimates 619 are interpolated over the frame to be used in a signal modification module 603.

The operations performed in the LP analysis and quantization module 601 and the pitch estimator 602 can be implemented in compliance with the above-mentioned AMR-WB Standard.

The signal modification module 603 of FIG. 4 performs a signal modification operation prior to the closed-loop pitch search of the adaptive codebook excitation signal for adjusting the speech signal to the determined delay contour d(t). In the illustrative embodiment, the delay contour d(t) defines a long term prediction delay for every sample of the frame. By construction the delay contour is fully characterized over the frame $t\epsilon(t_{n-1}, t_n]$ by a delay parameter 620 $d_n=d(t_n)$ and its previous value $d_{n-1}=d(t_{n-1})$ that are equal to the value of the delay contour at frame boundaries. The delay parameter 620 is determined as a part of the signal modification operation, and coded and then supplied to the multiplexer 614 where it is multiplexed into the bitstream 615.

The delay contour d(t) defining a long term prediction delay parameter for every sample of the frame is supplied to an adaptive codebook 607. The adaptive codebook 607 is responsive to the delay contour d(t) to form the adaptive codebook excitation $u_b(t)$ of the current subframe from the excitation u(t) using the delay contour d(t) as $u_b(t)=u(t-d(t))$. Thus the delay contour maps the past sample of the exitation signal u(t−d(t)) to the present sample in the adaptive codebook excitation $u_b(t)$.

The signal modification procedure produces also a modified residual signal ř(t) to be used for composing a modified target signal 621 for the closed-loop search of the fixed-codebook excitation $u_c(t)$. The modified residual signal ř(t) is obtained in the signal modification module 603 by warping the pitch cycle segments of the LP residual signal, and is supplied to the computation of the modified target signal in module 604. The LP synthesis filtering of the modified residual signal with the filter 1/A(z) yields then in module 604 the modified speech signal. The modified target signal 621 of the fixed-codebook excitation search is formed in module 604 in accordance with the operation of the AMR-WB Standard, but with the original speech signal replaced by its modified version.

After the adaptive codebook excitation $u_b(t)$ and the modified target signal 621 have been obtained for the current subframe, the encoding can further proceed using conventional means.

The function of the closed-loop fixed-codebook excitation search is to determine the fixed-codebook excitation signal $u_c(t)$ for the current subframe. To schematically illustrate the operation of the closed-loop fixed-codebook search, the fixed-codebook excitation $u_c(f)$ is gain scaled through an amplifier 610. In the same manner, the adaptive-codebook excitation $u_b(t)$ is gain scaled through an amplifier 609. The gain scaled adaptive and fixed-codebook excitations $u_b(t)$ and $u_c(t)$ are summed together through an adder 611 to form a total excitation signal u(t). This total excitation signal u(t) is processed through an LP synthesis filter 1/A(z) 612 to produce a synthesis speech signal 625 which is subtracted from the modified target signal 621 through an adder 605 to produce an error signal 626. An error weighting and minimization module 606 is responsive to the error signal 626 to calculate, according to conventional methods, the gain parameters for the amplifiers 609 and 610 every subframe. The error weighting and minimization module 606 further calculates, in accordance with conventional methods and in response to the error signal 626, the input 627 to the fixed codebook 608. The quantized gain parameters 622 and 623 and the parameters 624 characterizing the fixed-codebook excitation signal $u_c(t)$ are supplied to the multiplexer 614 and multiplexed into the bitstream 615. The above procedure is done in the same manner both when signal modification is enabled or disabled.

It should be noted that, when the signal modification functionality is disabled, the adaptive excitation codebook 607 operates according to conventional methods. In this case, a separate delay parameter is searched for every subframe in the adaptive codebook 607 to refine the open-loop pitch estimates 619. These delay parameters are coded, supplied to the multiplexer 614 and multiplexed into the bitstream 615. Furthermore, the target signal 621 for the fixed-codebook search is formed in accordance with conventional methods.

Figure 13:
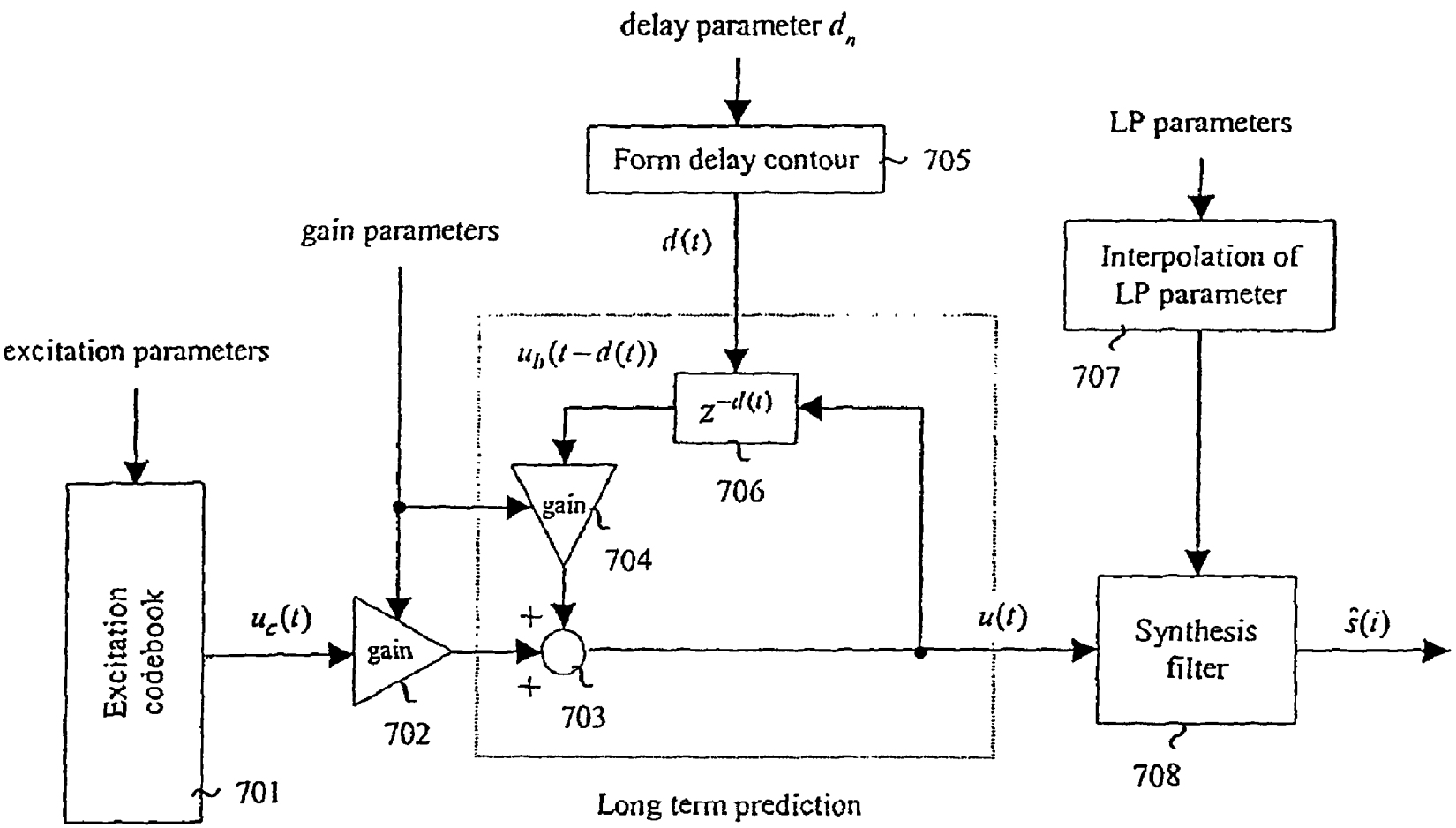
FIG. 13 is a schematic block diagram of an illustrative embodiment of speech decoder that utilizes the delay contour formed in accordance with an illustrative embodiment of the present invention.

The speech decoder as shown in FIG. 13 operates according to conventional methods except when signal modification is enabled. Signal modification disabled and enabled operation differs essentially only in the way the adaptive codebook excitation signal $u_b(t)$ is formed. In both operational modes, the decoder decodes the received parameters from their binary representation. Typically the received parameters include excitation, gain, delay and LP parameters. The decoded excitation parameters are used in module 701 to form the fixed-codebook excitation signal $u_c(t)$ for every subframe. This signal is supplied through an amplifier 702 to an adder 703. Similarly, the adaptive codebook excitation signal $u_b(t)$ of the current subframe is supplied to the adder 703 through an amplifier 704. In the adder 703, the gain-scaled adaptive and fixed-codebook excitation signals $u_b(t)$ and $u_c(t)$ are summed together to form a total excitation signal u(t) for the current subframe. This excitation signal u(t) is processed through the LP synthesis filter 1/A(z) 708, that uses LP parameters interpolated in module 707 for the current subframe, to produce the synthesized speech signal ŝ(t).

When signal modification is enabled, the speech decoder recovers the delay contour d(t) in module 705 using the received delay parameter $d_n$ and its previous received value $d_{n-1}$ as in the encoder. This delay contour d(t) defines a long term prediction delay parameter for every time instant of the current frame. The adaptive codebook excitation $u_b(t)=u(t-d(t))$ is formed from the past excitation for the current subframe as in the encoder using the delay contour d(t).

The remaining description discloses the detailed operation of the signal modification procedure 603 as well as its use as a part of the mode determination mechanism.

Search of Pitch Pulses and Pitch Cycle Segments

The signal modification method operates pitch and frame synchronously, shifting each detected pitch cycle segment individually but constraining the shift at frame boundaries. This requires means for locating pitch pulses and corresponding pitch cycle segments for the current frame. In the illustrative embodiment of the signal modification method, pitch cycle segments are determined based on detected pitch pulses that are searched according to FIG. 5.

Pitch pulse search can operate on the residual signal r(t), the weighted speech signal w(t) and/or the weighted synthesized speech signal ŵ(t). The residual signal r(t) is obtained by filtering the speech signal s(t) with the LP filter A(z), which has been interpolated for the subframes. In the illustrative embodiment, the order of the LP filter A(z) is 16. The weighted speech signal w(t) is obtained by processing the speech signal s(t) through the weighting filter $$W(z) = \frac{A(z/\gamma_1)}{1-\gamma_2 z^{-1}}, \tag{1}$$

where the coefficients $\gamma_1=0.92$ and $\gamma_2=0.68$. The weighted speech signal w(t) is often utilized in open-loop pitch estimation (module 602) since the weighting filter defined by Equation (1) attenuates the format structure in the speech signal s(t), and preserves the periodicity also on sinusoidal signal segments. That facilitates pitch pulse search because possible signal periodicity becomes clearly apparent in weighted signals. It should be noted that the weighted speech signal w(t) is needed also for the look ahead in order to search the last pitch pulse in the current frame. This can be done by using the weighting filter of Equation (1) formed in the last subframe of the current frame over the look ahead portion.

Figure 5:
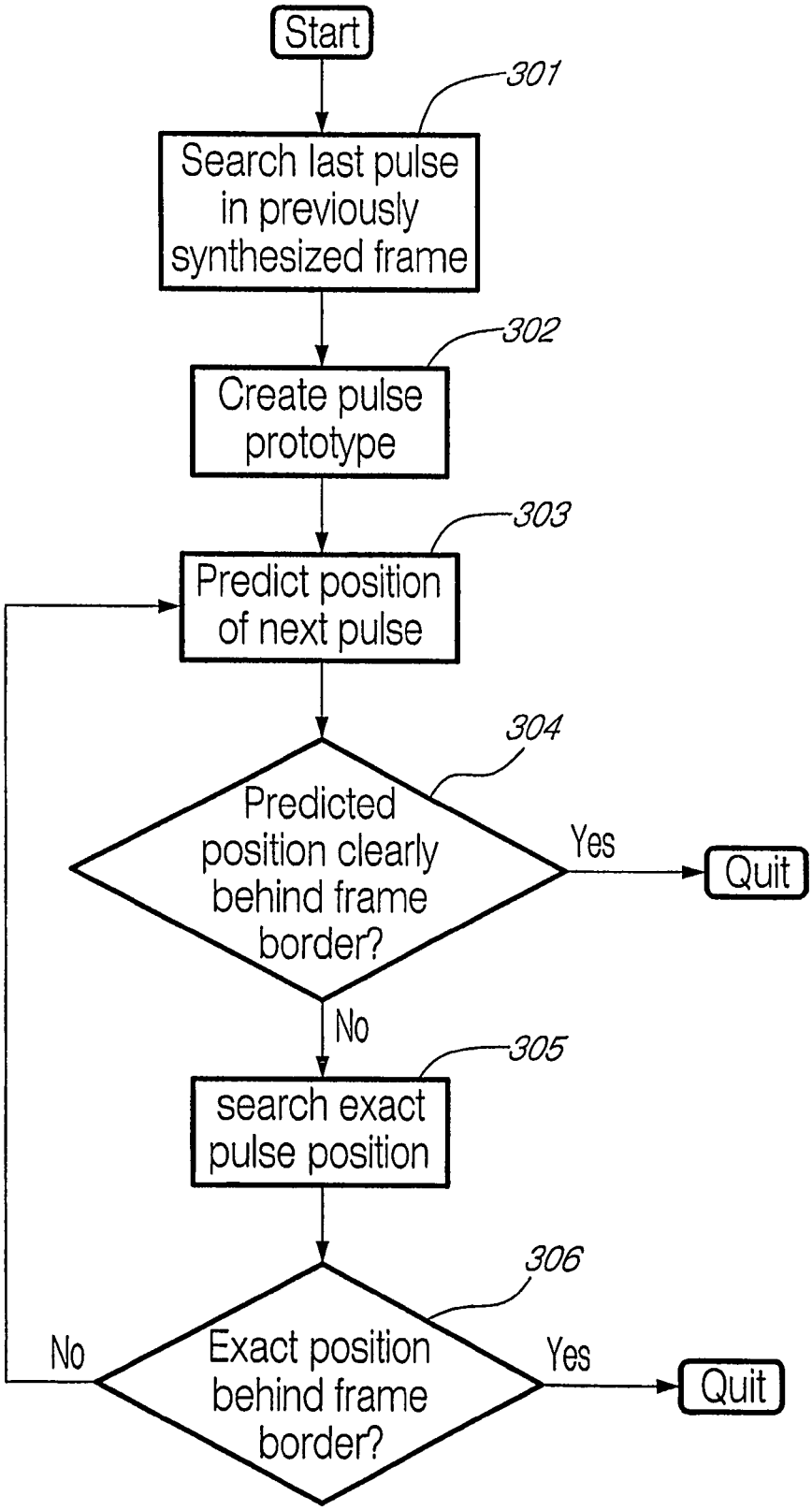
FIG. 5 is a functional block diagram of an illustrative embodiment of pitch pulse search.

The pitch pulse search procedure of FIG. 5 starts in block 301 by locating the last pitch pulse of the previous frame from the residual signal r(t). A pitch pulse typically stands out clearly as the maximum absolute value of the low-pass filtered residual signal in a pitch cycle having a length of approximately $p(t_{n-1})$. A normalized Hamming window $H_5(z)=(0.08\,z^{-2}+0.54\,z^{-1}+1+0.54\,z+0.08\,z^2)/2.24$ having a length of five (5) samples is used for the low-pass filtering in order to facilitate the locating of the last pitch pulse of the previous frame. This pitch pulse position is denoted by $T_O$. The illustrative embodiment of the signal modification method according to the invention does not require an accurate position for this pitch pulse, but rather a rough location estimate of the high-energy segment in the pitch cycle.

After locating the last pitch pulse at $T_0$ in the previous frame, a pitch pulse prototype of length 2l+1 samples is extracted in block 302 of FIG. 5 around this rough position estimate as, for example:

$$m_n(k)=\hat{w}(T_0-l+k) \text{ for } k=0, 1, \ldots, 2l \tag{2}$$

This pitch pulse prototype is subsequently used in locating pitch pulses in the current frame.

The synthesized weighted speech signal ŵ(t) (or the weighted speech signal w(t) can be used for the pulse prototype instead of the residual signal r(t). This facilitates pitch pulse search, because the periodic structure of the signal is better preserved in the weighted speech signal. The synthesized weighted speech signal ŵ(t) is obtained by filtering the synthesized speech signal ŝ(t) of the last subframe of the previous frame by the weighting filter W(z) of Equation (1). If the pitch pulse prototype extends over the end of the previously synthesized frame, the weighted speech signal w(t) of the current frame is used for this exceeding portion. The pitch pulse prototype has a high correlation with the pitch pulses of the weighted speech signal w(t) if the previous synthesized speech frame contains already a well-developed pitch cycle. Thus the use of the synthesized speech in extracting the prototype provides additional information for monitoring the performance of coding and selecting an appropriate coding mode in the current frame as will be explained in more detail in the following description.

Selecting l=10 samples provides a good compromise between the complexity and performance in the pitch pulse search. The value of l can also be determined proportionally to the open-loop pitch estimate.

Given the position $T_0$ of the last pulse in the previous frame, the first pitch pulse of the current frame can be predicted to occur approximately at instant $T_0+p(T_0)$. Here p(t) denotes the interpolated open-loop pitch estimate at instant (position) t. This prediction is performed in block 303.

In block 305, the predicted pitch pulse position $T_0+p(T_0)$ is refined as $$T_1=T_0+p(T_0)+\text{argmax}C(j) \tag{3}$$

where the weighted speech signal w(t) in the neighborhood of the predicted position is correlated with the pulse prototype:

$$C(j) = \gamma(j)\sum_{k=0}^{2l} m_n(k)w(T_0+p(T_0)+j-l+k), \quad j \in [-j_{max}, j_{max}]. \tag{4}$$

Thus the refinement is the argument j, limited into $[-j_{max}, j_{max}]$, that maximizes the weighted correlation C(j) between the pulse prototype and one of the above mentioned residual signal, weighted speech signal or weighted synthesized speech signal. According to an illustrative example, the limit $j_{max}$ is proportional to the open-loop pitch estimate as $\min\{20, \langle p(0)/4\rangle\}$, where the operator <•> denotes rounding to the nearest integer. The weighting function $$\gamma(j)=1-|j|/p(T_0+p(T_0)) \tag{5}$$

in Equation (4) favors the pulse position predicted using the open-loop pitch estimate, since γ(j) attains its maximum value 1 at j=0. The denominator $p(T_0+p(T_0))$ in Equation (5) is the open-loop pitch estimate for the predicted pitch pulse-position.

After the first pitch pulse position $T_1$ has been found using Equation (3), the next pitch pulse can be predicted to be at instant $T_2=T_1+p(T_1)$ and refined as described above. This pitch pulse search comprising the prediction 303 and refinement 305 is repeated until either the prediction or refinement procedure yields a pitch pulse position outside the current frame. These conditions are checked in logic block 304 for the prediction of the position of the next pitch pulse (block 303) and in logic block 306 for the refinement of this position of the pitch pulse (block 305). It should be noted that the logic block 304 terminates the search only if a predicted pulse position is so far in the subsequent frame that the refinement step cannot bring it back to the current frame. This procedure yields c pitch pulse positions inside the current frame, denoted by $T_1, T_2, \ldots, T_c$.

According to an illustrative example, pitch pulses are located in the integer resolution except the last pitch pulse of the frame denoted by $T_c$. Since the exact distance between the last pulses of two successive frames is needed to determine the delay parameter to be transmitted, the last pulse is located using a fractional resolution of ¼ sample in Equation (4) for j. The fractional resolution is obtained by upsampling w(t) in the neighborhood of the last predicted pitch pulse before evaluating the correlation of Equation (4). According to an illustrative example, Hamming-windowed sinc interpolation of length 33 is used for upsampling. The fractional resolution of the last pitch pulse position helps to maintain the good performance of long term prediction despite the time synchrony constrain set to the frame end. This is obtained with a cost of the additional bit rate needed for transmitting the delay parameter in a higher accuracy.

After completing pitch cycle segmentation in the current frame, an optimal shift for each segment is determined. This operation is done using the weighted speech signal w(t) as will be explained in the following description. For reducing the distortion caused by warping, the shifts of individual pitch cycle segments are implemented using the LP residual signal r(t). Since shifting distorts the signal particularly around segment boundaries, it is essential to place the boundaries in low power sections of the residual signal r(t). In an illustrative example, the segment boundaries are placed approximately in the middle of two consecutive pitch pulses, but constrained inside the current frame. Segment boundaries are always selected inside the current frame such that each segment contains exactly one pitch pulse. Segments with more than one pitch pulse or "empty" segments without any pitch pulses hamper subsequent correlation-based matching with the target signal and should be prevented in pitch cycle segmentation. The $s^{th}$ extracted segment of $l_s$ samples is denoted as $w_s(k)$ for $k=0, 1, \ldots, l_s-1$. The starting instant of this segment is $t_s$, selected such that $w_s(0)=w(t_s)$. The number of segments in the present frame is denoted by c.

While selecting the segment boundary between two successive pitch pulses $T_s$ and $T_{s+1}$ inside the current frame, the following procedure is used. First the central instant between two pulses is computed as $\Lambda=\langle(T_s+T_{s+1})/2\rangle$. The candidate positions for the segment boundary are located in the region $[\Lambda-\epsilon_{max}, \Lambda+\epsilon_{max}]$, where $\epsilon_{max}$ corresponds to five samples. The energy of each candidate boundary position is computed as $$Q(\epsilon')=r^2(\Lambda+\epsilon'-1)+r^2(\Lambda+\epsilon'),\ \epsilon'\epsilon[-\epsilon_{max},\epsilon_{max}] \quad (6)$$

The position giving the smallest energy is selected because this choice typically results in the smallest distortion in the modified speech signal. The instant that minimizes Equation (6) is denoted as $\epsilon$. The starting instant of the new segment is selected as $t_s=\Lambda+\epsilon$. This defines also the length of the previous segment, since the previous segment ends at instant $\Lambda+\epsilon-1$.

FIG. 6 shows an illustrative example of pitch cycle segmentation. Note particularly the first and the last segment $w_1(k)$ and $w_4(k)$, respectively, extracted such that no empty segments result and the frame boundaries are not exceeded.

Determination of the Delay Parameter

Generally the main advantage of signal modification is that only one delay parameter per frame has to be coded and transmitted to the decoder (not shown). However, special attention has to be paid to the determination of this single parameter. The delay parameter not only defines together with its previous value the evolution of the pitch cycle length over the frame, but also affects time asynchrony in the resulting modified signal.

In the methods described in [1, 4-7]

[1] W. B. Kleijn, P. Kroon, and D. Nahumi, "The RCELP speech-coding algorithm," European Transactions on Telecommunications, Vol. 4, No. 5, pp. 573-582, 1994.

[4] U.S. Pat. No. 5,704,003, "RCELP coder," Lucent Technologies Inc., (W. B. Kleijn and D. Nahumi), Filing Date 19 Sep. 1995.

[5] European Patent Application 0 602 826 A2, "Time shifting for analysis-by-synthesis coding," AT&T Corp., (B. Kleijn), Filing Date 1 Dec. 1993.

[6] Patent Application WO 00/11653, "Speech encoder with continuous warping combined with long term prediction," Conexant Systems Inc., (Y. Gao), Filing Date 24 Aug. 1999.

[7] Patent Application WO 00/11654, "Speech encoder adaptively applying pitch preprocessing with continuous warping," Conexant Systems Inc., (H. Su and Y. Gao), Filing Date 24 Aug. 1999.

no time synchrony is required at frame boundaries, and thus the delay parameter to be transmitted can be determined straightforwardly using an open-loop pitch estimate. This selection usually results in a time asynchrony at the frame boundary, and translates to an accumulating time shift in the subsequent frame because the signal continuity has to be preserved. Although human hearing is insensitive to changes in the time scale of the synthesized speech signal, increasing time asynchrony complicates the encoder implementation. Indeed, long signal buffers are required to accommodate the signals whose time scale may have been expanded, and a control logic has to be implemented for limiting the accumulated shift during encoding. Also, time asynchrony of several samples typical in RCELP coding may cause mismatch between the LP parameters and the modified residual signal. This mismatch may result in perceptual artifacts to the modified speech signal that is synthesized by LP filtering the modified residual signal.

On the contrary, the illustrative embodiment of the signal modification method according to the present invention preserves the time synchrony at frame boundaries. Thus, a strictly constrained shift occurs at the frame ends and every new frame starts in perfect time match with the original speech frame.

To ensure time synchrony at the frame end, the delay contour d(t) maps, with the long term prediction, the last pitch pulse at the end of the previous synthesized speech frame to the pitch pulses of the current frame. The delay contour defines an interpolated long-term prediction delay parameter over the current $n^{th}$ frame for every sample from instant $t_{n-1}+1$ through $t_n$. Only the delay parameter $d_n=d(t_n)$ at the frame end is transmitted to the decoder implying that d(t) must have a form fully specified by the transmitted values. The long-term prediction delay parameter has to be selected such that the resulting delay contour fulfils the pulse mapping. In a mathematical form this mapping can be presented as follows: Let $\kappa_c$ be a temporary time variable and $T_0$ and $T_c$ the last pitch pulse positions in the previous and current frames, respectively. Now, the delay parameter $d_n$ has to be selected such that, after executing the pseudo-code presented in Table 1, the variable $\kappa_c$ has a value very close to $T_0$ minimizing the error $|\kappa_c - T_0|$. The pseudo-code starts from the value $\kappa_0 = T_c$ and iterates backwards c times by updating $\kappa_i := \kappa_{i-1} - d(\kappa_{i-1})$. If $\kappa_c$ then equals to $T_0$, long term prediction can be utilized with maximum efficiency without time asynchrony at the frame end.

TABLE 1

Loop for searching the optimal delay parameter.

```
% initialization
κ0 := Tc;
% loop
for i = 1 to c
    κi := κi−1 − d(κi−1) ;
end;
```

Figure 7:
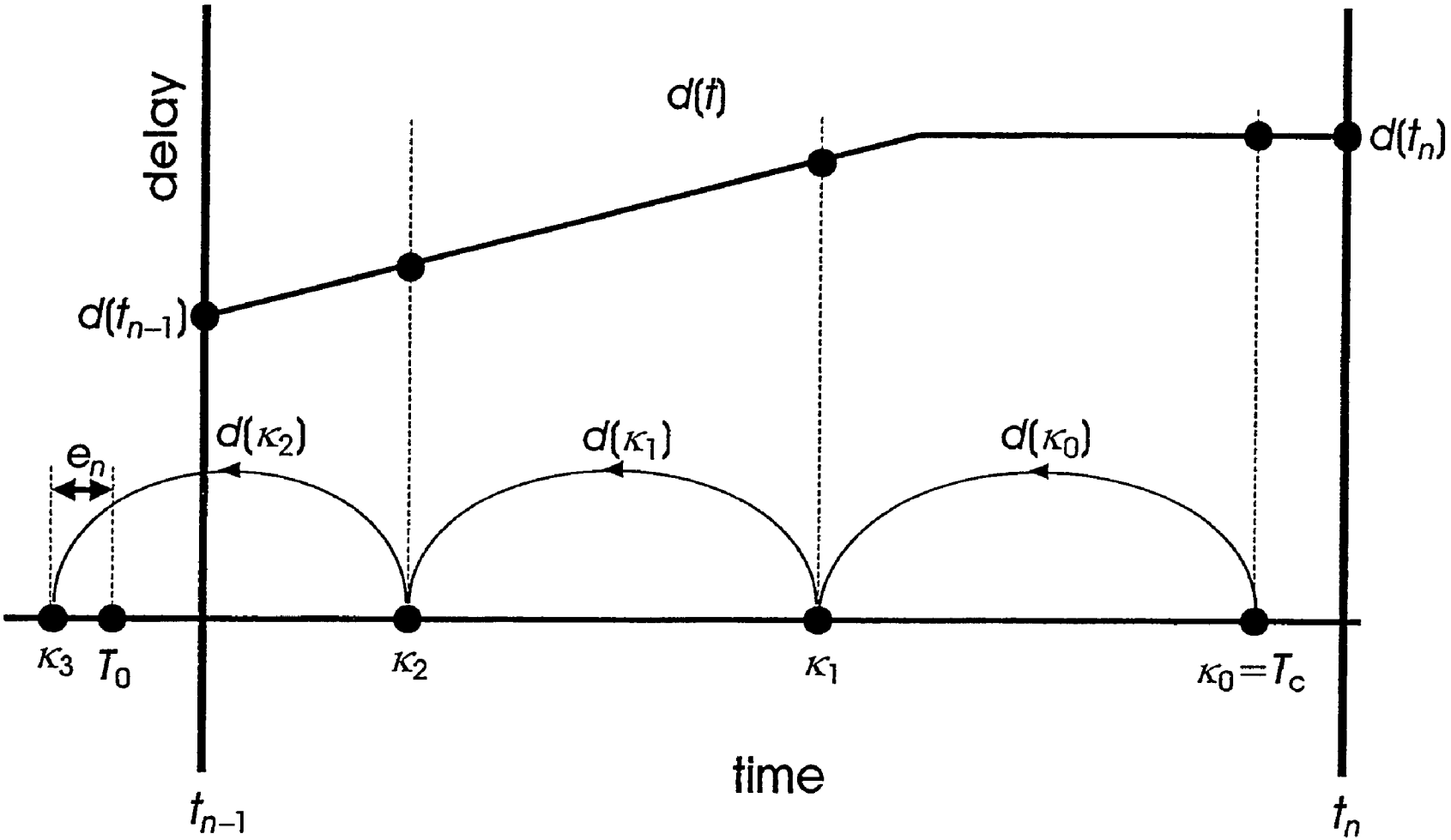
FIG. 7 is an illustrative example on determining a delay parameter when the number of pitch pulses is three (c=3)
Figure 8:
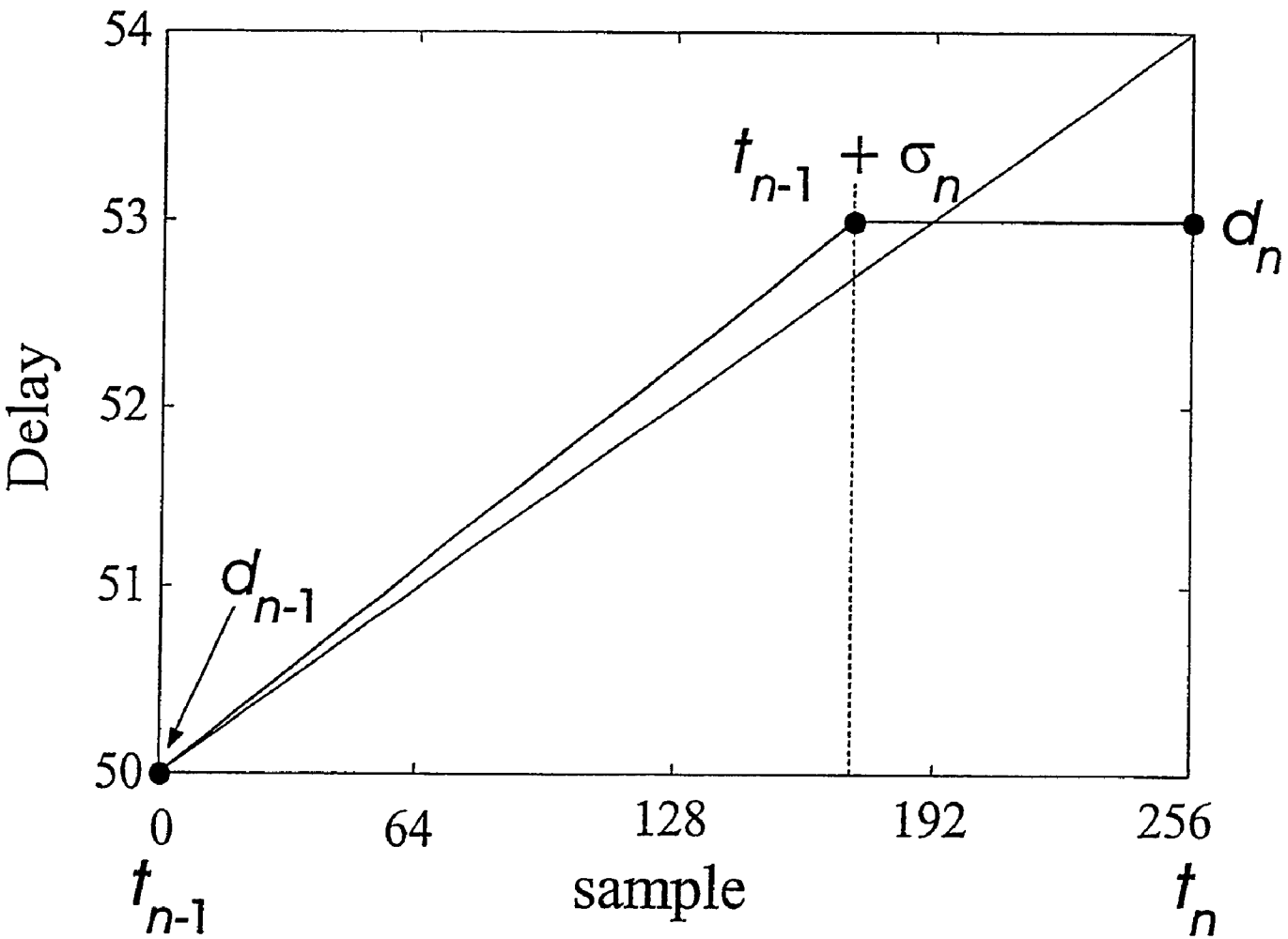

An example of the operation of the delay selection loop in the case c=3 is illustrated in FIG. 7. The loop starts from the value $\kappa_0 = T_c$ and takes the first iteration backwards as $\kappa_1 = \kappa_0 - d(\kappa_0)$. Iterations are continued twice more resulting in $\kappa_2 = \kappa_1 - d(\kappa_1)$ and $\kappa_3 = \kappa_2 - d(\kappa_2)$. The final value $\kappa_3$ is then compared against $T_0$ in terms of the error $\theta_n = |\kappa_3 - T_0|$. The resulting error is a function of the delay contour that is adjusted in the delay selection algorithm as will be taught later in this specification.

Signal modification methods [1, 4, 6, 7] such as described in the following documents:

[1] W. B. Kleijn, P. Kroon, and D. Nahumi, "The RCELP speech-coding algorithm," European Transactions on Telecommunications, Vol. 4, No. 5, pp. 573-582, 1994.

[4] U.S. Pat. No. 5,704,003, "RCELP coder," Lucent Technologies Inc., (W. B. Kleijn and D. Nahumi), Filing Date 19 Sep. 1995.

[6] Patent Application WO 00/11653, "Speech encoder with continuous warping combined with long term prediction," Conexant Systems Inc., (Y. Gao), Filing Date 24 Aug. 1999.

[7] Patent Application WO 00/11654, "Speech encoder adaptively applying pitch preprocessing with continuous warping," Conexant Systems Inc., (H. Su and Y. Gao), Filing Date 24 Aug. 1999.

interpolate the delay parameters linearly over the frame between $d_{n-1}$ and $d_n$. However, when time synchrony is required at the frame end, linear interpolation tends to result in an oscillating delay contour. Thus pitch cycles in the modified speech signal contract and expand periodically causing easily annoying artifacts. The evolution and amplitude of the oscillations are related to the last pitch position. The further the last pitch pulse is from the frame end in relation to the pitch period, the more likely the oscillations are amplified. Since the time synchrony at the frame end is an essential requirement of the illustrative embodiment of the signal modification method according to the present invention, linear interpolation familiar from the prior methods cannot be used without degrading the speech quality. Instead, the illustrative embodiment of the signal modification method according to the present invention discloses a piecewise linear delay contour $$d(t) = \begin{cases} (1-\alpha(t))d_{n-1} + \alpha(t)d_n & t_{n-1} < t < t_{n-1} + \sigma_n \\ d_n & t_{n-1} + \sigma_n \le t \le t_n \end{cases} \tag{7}$$

where $$\alpha(t) = (t - t_{n-1})/\sigma_n. \tag{8}$$

Oscillations are significantly reduced by using this delay contour. Here $t_n$ and $t_{n-1}$ are the end instants of the current and previous frames, respectively, and $d_n$ and $d_{n-1}$ are the corresponding delay parameter values. Note that $t_{n-1} + \sigma_n$ is the instant after which the delay contour remains constant.

In an illustrative example, the parameter $\sigma_n$ varies as a function of $d_{n-1}$ as $$\sigma_n = \begin{cases} 172 \text{ samples}, & d_{n-1} \le 90 \text{ samples} \\ 128 \text{ samples}, & d_{n-1} > 90 \text{ samples} \end{cases} \tag{9}$$

and the frame length N is 256 samples. To avoid oscillations, it is beneficial to decrease the value of $\sigma_n$ as the length of the pitch cycle increases. On the other hand, to avoid rapid changes in the delay contour d(t) in the beginning of the frame as $t_{n-1} < t < t_{n-1} + \sigma_n$, the parameter $\sigma_n$ has to be always at least a half of the frame length. Rapid changes in d(t) degrade easily the quality of the modified speech signal.

Note that depending on the coding mode of the previous frame, $d_{n-1}$ can be either the delay value at the frame end (signal modification enabled) or the delay value of the last subframe (signal modification disabled). Since the past value $d_{n-1}$ of the delay parameter is known at the decoder, the delay contour is unambiguously defined by $d_n$, and the decoder is able to form the delay contour using Equation (7).

The only parameter which can be varied while searching the optimal delay contour is $d_n$, the delay parameter value at the end of the frame constrained into [34, 231]. There is no simple explicit method for solving the optimal $d_n$ in a general case. Instead, several values have to be tested to find the best solution. However, the search is straightforward. The value of $d_n$ can be first predicted as $$d_n^{(0)} = 2\frac{T_c - T_0}{c} - d_{n-1}. \tag{10}$$

In the illustrative embodiment, the search is done in three phases by increasing the resolution and focusing the search range to be examined inside [34, 231] in every phase. The delay parameters giving the smallest error $e_n = |\kappa_c - T_0|$ in the procedure of Table 1 in these three phases are denoted by $d_n^{(1)}$, $d_n^{(2)}$, and $d_n = d_n^{(3)}$, respectively. In the first phase, the search is done around the value $d_n^{(0)}$ predicted using Equation (10) with a resolution of four samples in the range $[d_n^{(0)} - 11, d_n^{(0)} + 12]$ when $d_n^{(0)} < 60$, and in the range $[d_n^{(0)} - 15, d_n^{(0)} + 16]$ otherwise. The second phase constrains the range into $[d_n^{(1)} - 3, d_n^{(1)} + 3]$ and uses the integer resolution. The last, third phase examines the range $[d_n^{(2)} - ¾, d_n^{(2)} + ¾]$ with a resolution of ¼ sample for $d_n^{(2)} < 92½$. Above that range $[d_n^{(2)} - ½, d_n^{(2)} + ½]$ and a resolution of ½ sample is used. This third phase yields the optimal delay parameter $d_n$ to be transmitted to the decoder. This procedure is a compromise between the search accuracy and complexity. Of course, those of ordinary skill in the art can readily implement the search of the delay parameter under the time synchrony constrains using alternative means without departing from the nature and spirit of the present invention.

The delay parameter $d_n \epsilon [34, 231]$ can be coded using nine bits per frame using a resolution of ¼ sample for $d_n < 92\frac{1}{2}$ and ½ sample for $d_n > 92\frac{1}{2}$.

Figure 8:
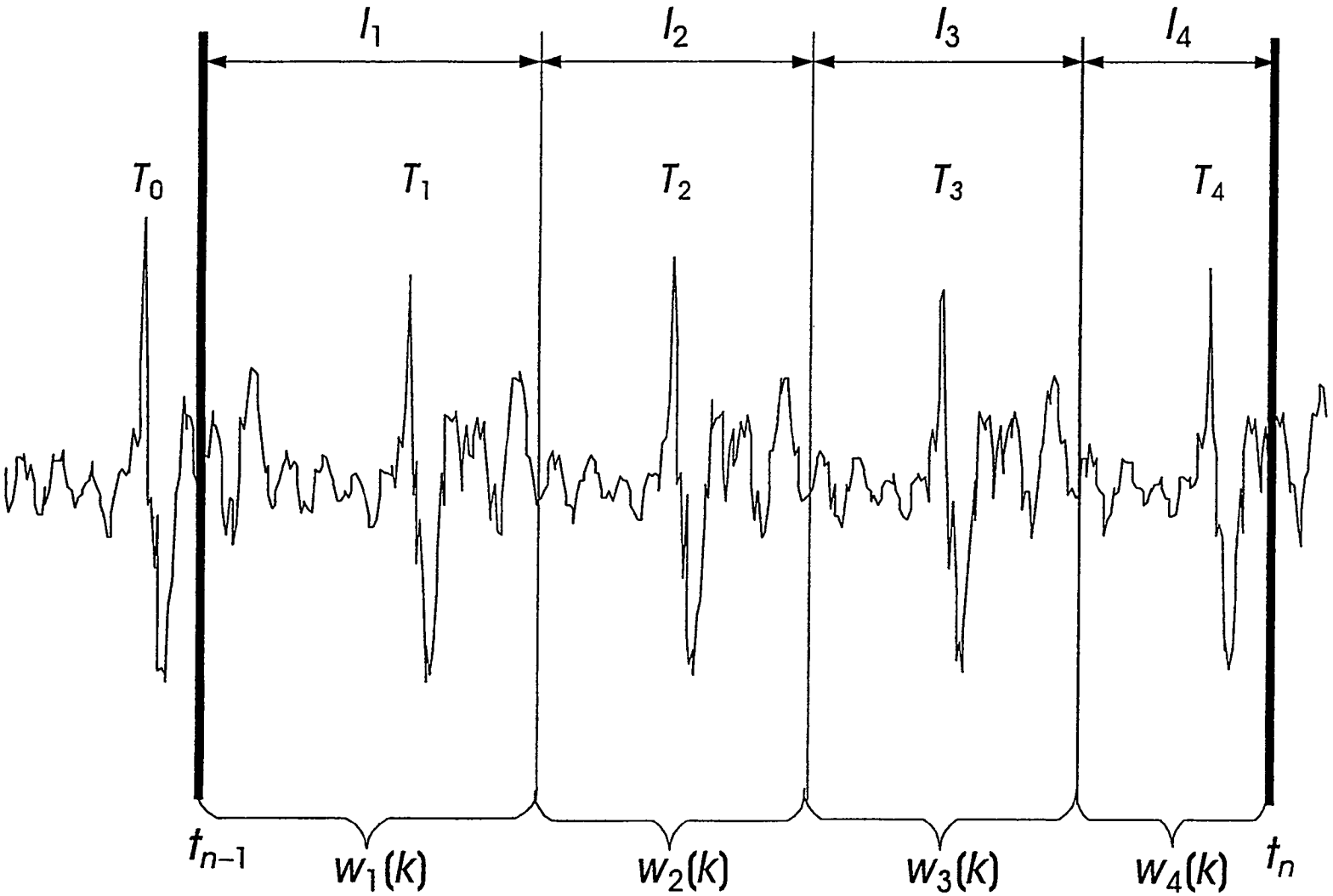
FIG. 8 is an illustrative example of delay interpolation (thick line) over a speech frame compared to linear interpolation (thin line)

FIG. 8 illustrates delay interpolation when $d_{n-1}=50$, $d_n=53$, $\sigma_n=172$, and the frame length N=256. The interpolation method used in the illustrative embodiment of the signal modification method is shown in thick line whereas the linear interpolation corresponding to prior methods is shown in thin line. Both interpolated contours perform approximately in a similar manner in the delay selection loop of Table 1, but the disclosed piecewise linear interpolation results in a smaller absolute change $|d_{n-1}-d_n|$. This feature reduces potential oscillations in the delay contour d(t) and annoying artifacts in the modified speech signal whose pitch will follow this delay contour.

Figure 9:
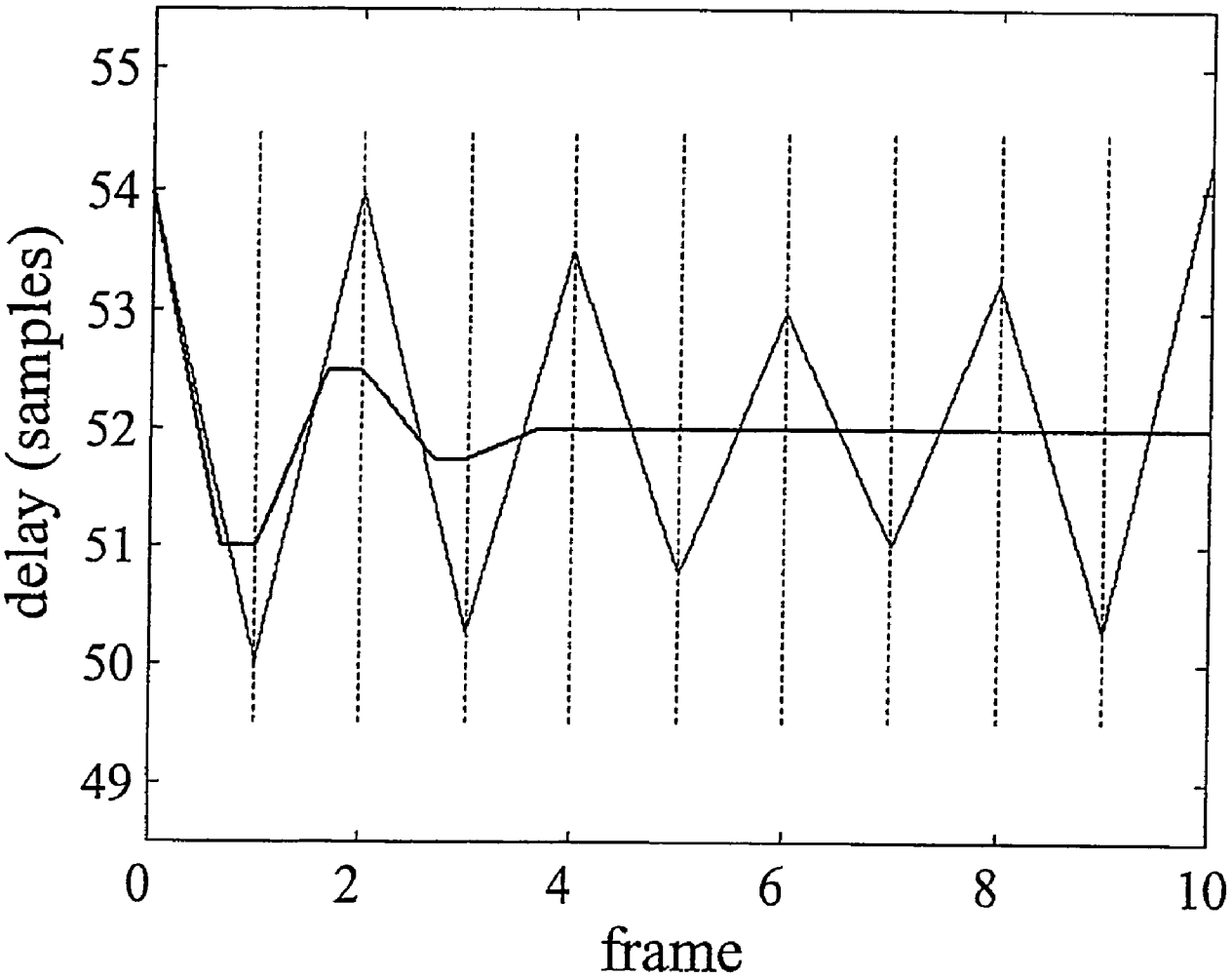
FIG. 9 is an illustrative example of a delay contour over ten frames selected in accordance with the delay interpolation (thick line) of FIG. 8 and linear interpolation (thin line) when the correct pitch value is 52 samples.

To further clarify the performance of the piecewise linear interpolation method, FIG. 9 shows an example on the resulting delay contour d(t) over ten frames with thick line. The corresponding delay contour d(t) obtained with conventional linear interpolation is indicated with thin line. The example has been composed using an artificial speech signal having a constant delay parameter of 52 samples as an input of the speech modification procedure. A delay parameter $d_0=54$ samples was intentionally used as an initial value for the first frame to illustrate the effect of pitch estimation errors typical in speech coding. Then, the delay parameters $d_n$ both for the linear interpolation and the herein disclosed piecewise linear interpolation method were searched using the procedure of Table 1. All the parameters needed were selected in accordance with the illustrative embodiment of the signal modification method according to the present invention. The resulting delay contours d(t) show that piecewise linear interpolation yields a rapidly converging delay contour d(t) whereas the conventional linear interpolation cannot reach the correct value within the ten frame period. These prolonged oscillations in the delay contour d(t) often cause annoying artifacts to the modified speech signal degrading the overall perceptual quality.

Modification of the Signal

After the delay parameter $d_n$ and the pitch cycle segmentation have been determined, the signal modification procedure itself can be initiated. In the illustrative embodiment of the signal modification method, the speech signal is modified by shifting individual pitch cycle segments one by one adjusting them to the delay contour d(t). A segment shift is determined by correlating the segment in the weighted speech domain with the target signal. The target signal is composed using the synthesized weighted speech signal $\hat{w}(t)$ of the previous frame and the preceding, already shifted segments in the current frame. The actual shift is done on the residual signal r(t).

Signal modification has to be done carefully to both maximize the performance of long term prediction and simultaneously to preserve the perceptual quality of the modified speech signal. The required time synchrony at frame boundaries has to be taken into account also during modification.

Figure 10:
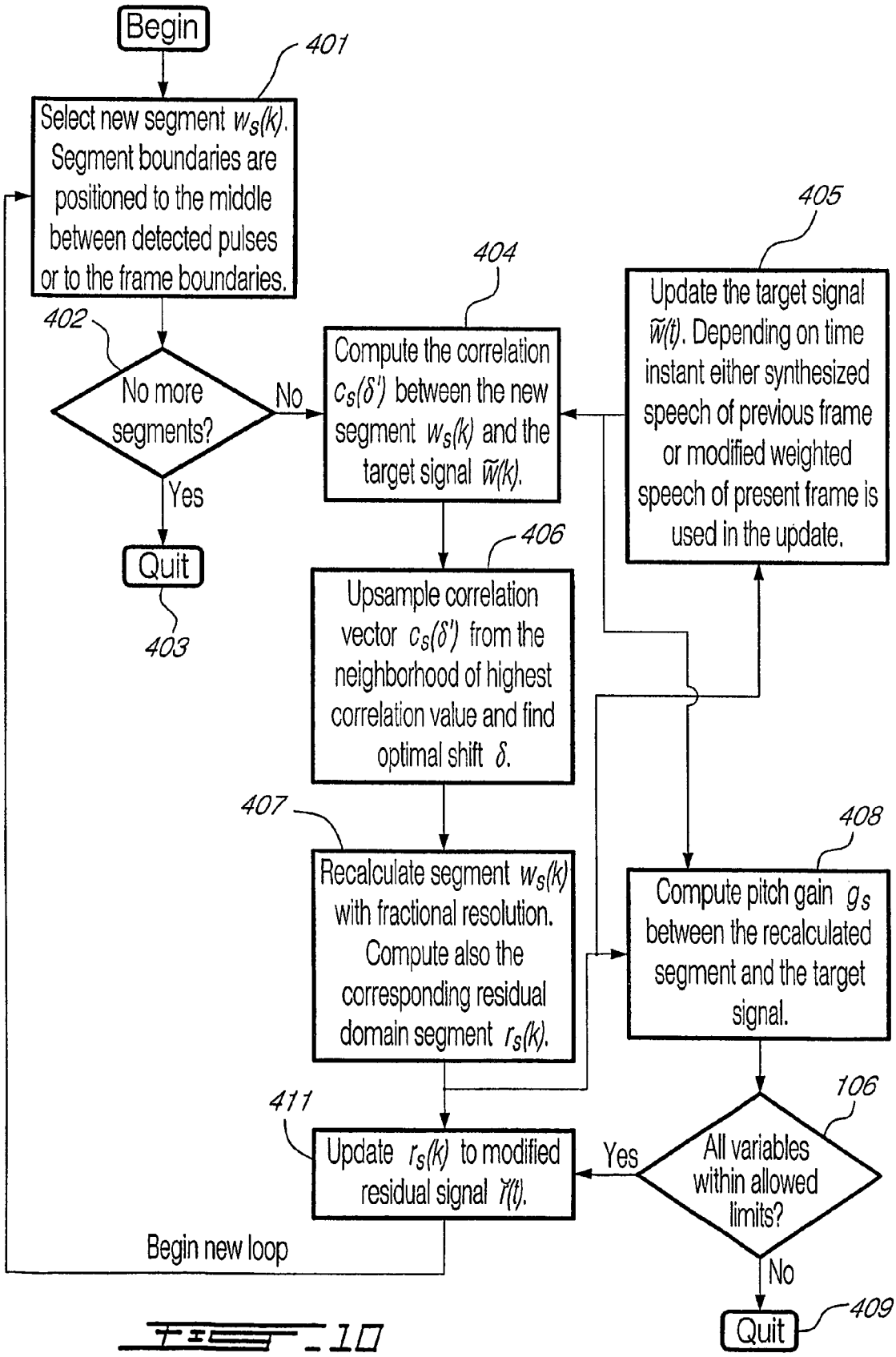
FIG. 10 is a functional block diagram of the signal modification method that adjusts the speech frame to the selected delay contour in accordance with an illustrative embodiment of the present invention.

A block diagram of the illustrative embodiment of the signal modification method is shown in FIG. 10. Modification starts by extracting a new segment $w_s(k)$ of $l_s$ samples from the weighted speech signal w(t) in block 401. This segment is defined by the segment length $l_s$ and starting instant $t_s$ giving $w_s(k)=w(t_s+k)$ for k=0, 1, . . . , $l_s-1$. The segmentation procedure is carried out in accordance with the teachings of the foregoing description.

If no more segments can be selected or extracted (block 402), the signal modification operation is completed (block 403). Otherwise, the signal modification operation continues with block 404.

For finding the optimal shift of the current segment $w_s(k)$, a target signal $\tilde{w}(t)$ is created in block 405. For the first segment $w_1(k)$ in the current frame, this target signal is obtained by the recursion $$\tilde{w}(t)=\hat{w}(t),\ t \leqq t_{n-1}$$

$$\tilde{w}(t)=\tilde{w}(t-d(t)),\ t_{n-1}<t<t_{n-1}+l_1+\delta_1 \tag{11}$$

Here $\hat{w}(t)$ is the weighted synthesized speech signal available in the previous frame for $t \leqq t_{n-1}$. The parameter $\delta_1$ is the maximum shift allowed for the first segment of length $l_1$. Equation (11) can be interpreted as simulation of long term prediction using the delay contour over the signal portion in which the current shifted segment may potentially be situated. The computation of the target signal for the subsequent segments follows the same principle and will be presented later in this section.

The search procedure for finding the optimal shift of the current segment can be initiated after forming the target signal. This procedure is based on the correlation $c_s(\delta')$ computed in block 404 between the segment $w_s(k)$ that starts at instant $t_s$ and the target signal $\tilde{w}(t)$ as $$c_s(\delta') = \sum_{k=0}^{l_s-1} w_s(k)\tilde{w}(k+t_s+\delta'),$$
$$\delta' \in [-\lceil \delta_S \rceil, \lceil \delta_S \rceil], \tag{12}$$

where $\delta_s$ determines the maximum shift allowed for the current segment $w_s(k)$ and $\lceil \bullet \rceil$ denotes rounding towards plus infinity. Normalized correlation can be well used instead of Equation (12), although with increased complexity. In the illustrative embodiment, the following values are used for $\delta_s$:

$$\delta_s = \begin{cases} 4\frac{1}{2} \text{ samples}, & d_n < 90 \text{ samples} \\ 5 \text{ samples}, & d_n \geq 90 \text{ samples} \end{cases} \tag{13}$$

As will be described later in this section, the value of $\delta_s$ is more limited for the first and the last segment in the frame.

Correlation (12) is evaluated with an integer resolution, but higher accuracy improves the performance of long term prediction. For keeping the complexity low it is not reasonable to upsample directly the signal $w_s(k)$ or $\tilde{w}(t)$ in Equation (12). Instead, a fractional resolution is obtained in a computationally efficient manner by determining the optimal shift using the upsampled correlation $c_s(\delta')$.

The shift δ maximizing the correlation $c_s(\delta')$ is searched first in the integer resolution in block 404. Now, in a fractional resolution the maximum value must be located in the open interval (δ−1, δ+1), and bounded into $[-\delta_s, \delta_s]$. In block 406, the correlation $c_s(\delta')$ is upsampled in this interval to a resolution of ⅛ sample using Hamming-windowed sinc interpolation of a length equal to 65 samples. The shift δ corresponding to the maximum value of the upsampled correlation is then the optimal shift in a fractional resolution. After finding this optimal shift, the weighted speech segment $w_s(k)$ is recalculated in the solved fractional resolution in block 407. That is, the precise new starting instant of the segment is updated as $t_s := t_s - \delta + \delta_l$, where $\delta_l = \lceil \delta \rceil$. Further, the residual segment $r_s(k)$ corresponding to the weighted speech segment $w_s(k)$ in fractional resolution is computed from the residual signal r(t) at this point using again the sinc interpolation as described before (block 407). Since the fractional part of the optimal shift is incorporated into the residual and weighted speech segments, all subsequent computations can be implemented with the upward-rounded shift $\delta_I=\lceil\delta\rceil$.

Figure 11:
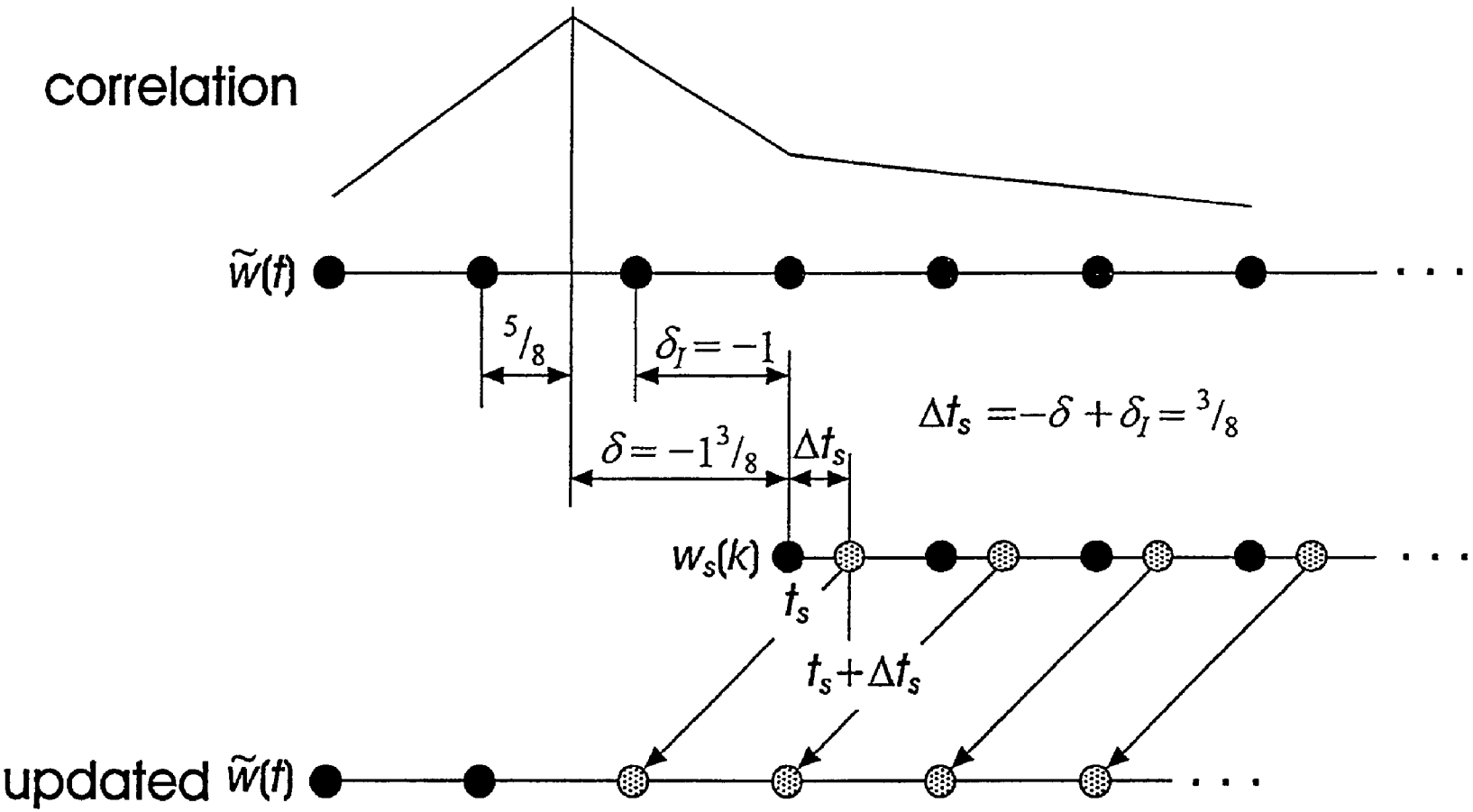
FIG. 11 is an illustrative example on updating the target signal $\tilde{w}(t)$ using a determined optimal shift $\delta$, and on replacing the signal segment $w_s(k)$ with interpolated values shown as gray dots.

FIG. 11 illustrates recalculation of the segment $w_s(k)$ in accordance with block 407 of FIG. 10. In this illustrative example, the optimal shift is searched with a resolution of ⅛ sample by maximizing the correlation giving the value $\delta=-1\frac{3}{8}$. Thus the integer part $\delta_I$ becomes $\lceil -1\frac{3}{8}\rceil=-1$ and the fractional part ⅜. Consequently, the starting instant of the segment is updated as $t_s=t_s+\frac{3}{8}$. In FIG. 11, the new samples of $w_s(k)$ are indicated with gray dots.

If the logic block 106, which will be disclosed later, permits to continue signal modification, the final task is to update the modified residual signal ř(t) by copying the current residual signal segment $r_s(k)$ into it (block 411):

$$\check{r}(t_s+\delta_I+k)=r_s(k),\ k=0,1,\ldots,l_s-1 \tag{14}$$

Since shifts in successive segments are independent from each others, the segments positioned to ř(t) either overlap or have a gap in between them. Straightforward weighted averaging can be used for overlapping segments. Gaps are filled by copying neighboring samples from the adjacent segments. Since the number of overlapping or missing samples is usually small and the segment boundaries occur at low-energy regions of the residual signal, usually no perceptual artifacts are caused. It should be noted that no continuous signal warping as described in [2], [6], [7],

[2] W. B. Kleijn, R. P. Ramachandran, and P. Kroon, "Interpolation of the pitch-predictor parameters in analysis-by-synthesis speech coders," IEEE Transactions on Speech and Audio Processing, Vol. 2, No. 1, pp. 42-54, 1994.

[6] Patent Application WO 00/11653, "Speech encoder with continuous warping combined with long term prediction," Conexant Systems Inc., (Y. Gao), Filing Date 24 Aug. 1999.

[7] Patent Application WO 00/11654, "Speech encoder adaptively applying pitch preprocessing with continuous warping," Conexant Systems Inc., (H. Su and Y. Gao), Filing Date 24 Aug. 1999.

is employed, but modification is done discontinuously by shifting pitch cycle segments in order to reduce the complexity.

Processing of the subsequent pitch cycle segments follows the above-disclosed procedure, except the target signal $\tilde{w}(t)$ in block 405 is formed differently than for the first segment. The samples of $\tilde{w}(t)$ are first replaced with the modified weighted speech samples as $$\tilde{w}(t_s+\delta_I+k)=w_s(k),\ k=0,1,\ldots,l_s-1 \tag{15}$$

This procedure is illustrated in FIG. 11. Then the samples following the updated segment are also updated, $$\tilde{w}(k)=\tilde{w}(k-d(k)),\ k=t_s+\delta_I+l_s,\ldots,t_s+\delta_I+l_s+l_{s+1}+\delta_{s+1}-2 \tag{16}$$

The update of target signal $\tilde{w}(t)$ ensures higher correlation between successive pitch cycle segments in the modified speech signal considering the delay contour d(t) and thus more accurate long term prediction. While processing the last segment of the frame, the target signal $\tilde{w}(t)$ does not need to be updated.

The shifts of the first and the last segments in the frame are special cases which have to be performed particularly carefully. Before shifting the first segment, it should be ensured that no high power regions exist in the residual signal r(t) close to the frame boundary $t_{n-1}$, because shifting such a segment may cause artifacts. The high power region is searched by squaring the residual signal r(t) as $$E_0(k)=r^2(k),\ k\in[t_{n-1}-\delta_0,\ t_{n-1}+\delta_0] \tag{17}$$

where $\delta_0=\langle p(t_{n-1})/2\rangle$. If the maximum of $E_0(k)$ is detected close to the frame boundary in the range $[t_{n-1}-2,\ t_{n-1}+2]$, the allowed shift is limited to ¼ samples. If the proposed shift $|\delta|$ for the first segment is smaller that this limit, the signal modification procedure is enabled in the current frame, but the first segment is kept intact.

The last segment in the frame is processed in a similar manner. As was described in the foregoing description, the delay contour d(t) is selected such that in principle no shifts are required for the last segment. However, because the target signal is repeatedly updated during signal modification considering correlations between successive segments in Equations (16) and (17), it is possible the last segment has to be shifted slightly. In the illustrative embodiment, this shift is always constrained to be smaller than 3/2 samples. If there is a high power region at the frame end, no shift is allowed. This condition is verified by using the squared residual signal $$E_1(k)=r^2(k),\ k\in[t_n-\delta_1+1,\ t_n+1] \tag{18}$$

where $\delta_1=p(t_n)$. If the maximum of $E_1(k)$ is attained for k larger than or equal to $t_n-4$, no shift is allowed for the last segment. Similarly as for the first segment, when the proposed shift $|\delta|<\frac{1}{4}$, the present frame is still accepted for modification, but the last segment is kept intact.

It should be noted that, contrary to the known signal modification methods, the shift does not translate to the next frame, and every new frame starts perfectly synchronized with the original input signal. As another fundamental difference particularly to RCELP coding, the illustrative embodiment of signal modification method processes a complete speech frame before the subframes are coded. Admittedly, subframe-wise modification enables to compose the target signal for every subframe using the previously coded subframe potentially improving the performance. This approach cannot be used in the context of the illustrative embodiment of the signal modification method since the allowed time asynchrony at the frame end is strictly constrained. Nevertheless, the update of the target signal with Equations (15) and (16) gives practically speaking equal performance with the subframe-wise processing, because modification is enabled only on smoothly evolving voiced frames.

Mode Determination Logic Incorporated into the Signal Modification Procedure

The illustrative embodiment of signal modification method according to the present invention incorporates an efficient classification and mode determination mechanism as depicted in FIG. 2. Every operation performed in blocks 101, 103 and 105 yields several indicators quantifying the attainable performance of long term prediction in the current frame. If any of these indicators is outside its allowed limits, the signal modification procedure is terminated by one of the logic blocks 102, 104, or 106. In this case, the original signal is preserved intact.

The pitch pulse search procedure 101 produces several indicators on the periodicity of the present frame. Hence the logic block 102 analyzing these indicators is the most important component of the classification logic. The logic block 102 compares the difference between the detected pitch pulse positions and the interpolated open-loop pitch estimate using the condition $$|T_k-T_{k-1}-p(T_k)|<0.2p(T_k),\ k=1,2,\ldots,c \tag{19}$$

and terminates the signal modification procedure if this condition is not met.

The selection of the delay contour d(t) in block 103 gives also additional information on the evolution of the pitch cycles and the periodicity of the current speech frame. This information is examined in the logic block 104. The signal modification procedure is continued from this block 104 only if the condition $|d_n-d_{n-1}|<0.2\ d_n$ is fulfilled. This condition means that only a small delay change is tolerated for classifying the current frame as purely voiced frame. The logic block 104 also evaluates the success of the delay selection loop of Table 1 by examining the difference $|\kappa_c-T_0|$ for the selected delay parameter value $d_n$. If this difference is greater than one sample, the signal modification procedure is terminated.

For guaranteeing a good quality for the modified speech signal, it is advantageous to constrain shifts done for successive pitch cycle segments in block 105. This is achieved in the logic block 106 by imposing the criteria $$|\delta^{(s)}-\delta_r^{(s-1)}|\le\begin{cases}4.0\text{ samples}, & d_n<90\text{ samples}\\ 4.8\text{ samples}, & d_n\ge 90\text{ samples}\end{cases}\tag{20}$$

to all segments of the frame. Here $\delta^{(s)}$ and $\delta^{(s-1)}$ are the shifts done for the $s^{th}$ and $(s-1)^{th}$ pitch cycle segments, respectively. If the thresholds are exceeded, the signal modification procedure is interrupted and the original signal is maintained.

When the frames subjected to signal modification are coded at a low bit rate, it is essential that the shape of pitch cycle segments remains similar over the frame. This allows faithful signal modeling by long term prediction and thus coding at a low bit rate without degrading the subjective quality. The similarity of successive segments can be quantified simply by the normalized correlation $$g_s=\frac{\sum_{k=0}^{t_s-1}w_s(k)\tilde{w}(k+t_s+\delta_l)}{\sqrt{\sum_{k=0}^{t_s-1}w^2(k)\sum_{k=0}^{t_s-1}\tilde{w}^2(k+t_s+\delta_l)}}\tag{21}$$

between the current segment and the target signal at the optimal shift after the update of $w_s(k)$ in block 407 of FIG. 10. The normalized correlation $g_s$ is also referred to as pitch gain.

Shifting of the pitch cycle segments in block 105 maximizing their correlation with the target signal enhances the periodicity and yields a high pitch prediction gain if the signal modification is useful in the current frame. The success of the procedure is examined in the logic block 106 using the criteria $$g_s\geqq 0.84.$$

If this condition is not fulfilled for all segments, the signal modification procedure is terminated (block 409) and the original signal is kept intact. When this condition is met (block 106), the signal modification continues in block 411. The pitch gain $g_s$ is computed in block 408 between the recalculated segment $w_s(k)$ from block 407 and the target signal $\tilde{w}(t)$ from block 405. In general, a slightly lower gain threshold can be allowed on male voices with equal coding performance. The gain thresholds can be changed in different operation modes of the encoder for adjusting the usage percentage of the signal modification mode and thus the resulting average bit rate.

Mode Determination Logic for a Source-Controlled Variable Bit Rate Speech Codec

This section discloses the use of the signal modification procedure as a part of the general rate determination mechanism in a source-controlled variable bit rate speech codec. This functionality is immersed into the illustrative embodiment of the signal modification method, since it provides several indicators on signal periodicity and the expected coding performance of long term prediction in the present frame. These indicators include the evolution of pitch period, the fitness of the selected delay contour for describing this evolution, and the pitch prediction gain attainable with signal modification. If the logic blocks 102, 104 and 106 shown in FIG. 2 enable signal modification, long term prediction is able to model the modified speech frame efficiently facilitating its coding at a low bit rate without degrading subjective quality. In this case, the adaptive codebook excitation has a dominant contribution in describing the excitation signal, and thus the bit rate allocated for the fixed-codebook excitation can be reduced. When a logic block 102, 104 or 106 disables signal modification, the frame is likely to contain an non-stationary speech segment such as a voiced onset or rapidly evolving voiced speech signal. These frames typically require a high bit rate for sustaining good subjective quality.

Figure 12:
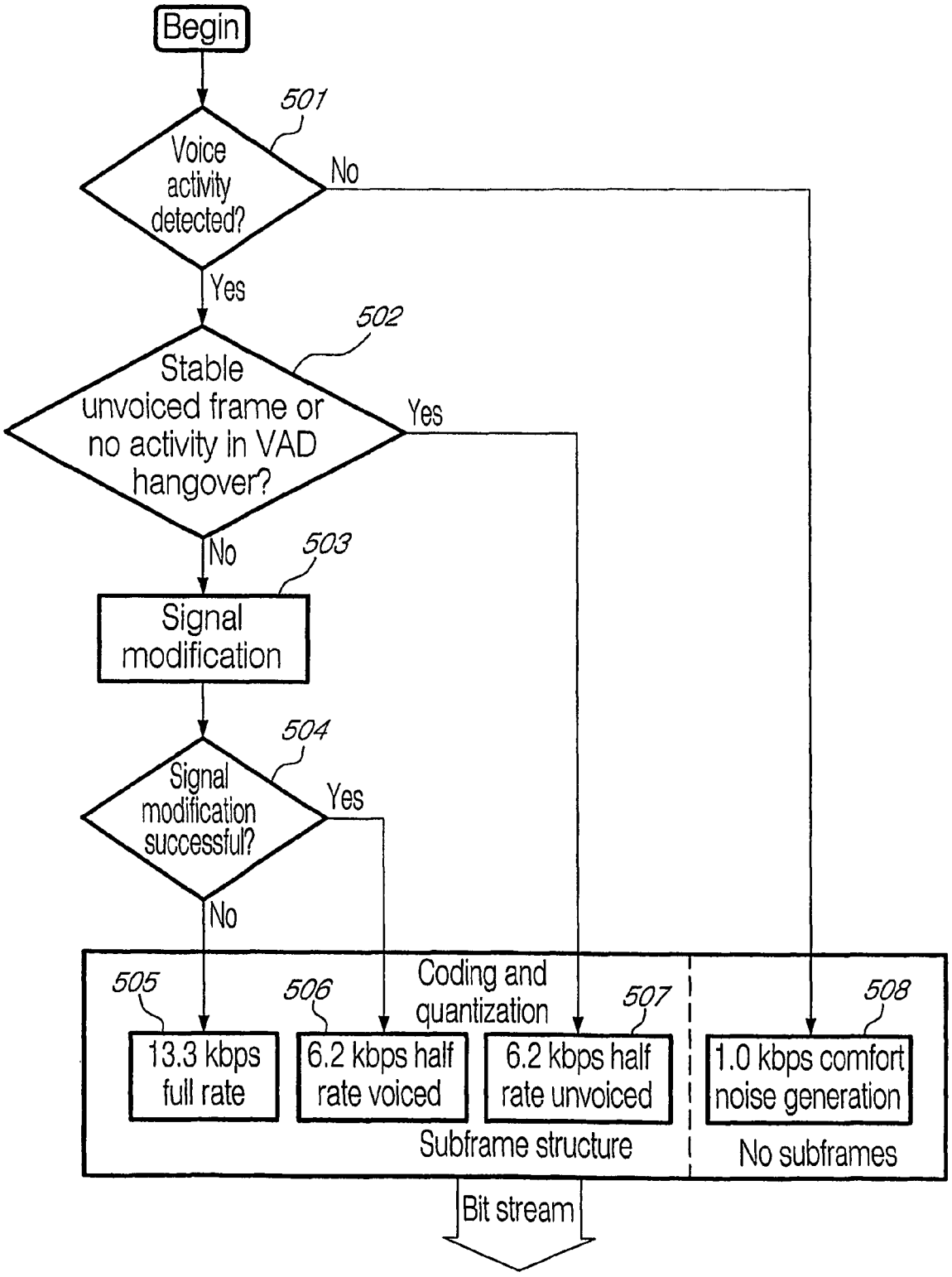
FIG. 12 is a functional block diagram of a rate determination logic in accordance with an illustrative embodiment of the present invention.

FIG. 12 depicts the signal modification procedure 603 as a part of the rate determination logic that controls four coding modes. In this illustrative embodiment, the mode set comprises a dedicated mode for non-active speech frames (block 508), unvoiced speech frames (block 507), stable voiced frames (block 506), and other types of frames (block 505). It should be noted that all these modes except the mode for stable voiced frames 506 are implemented in accordance with techniques well known to those of ordinary skill in the art.

The rate determination logic is based on signal classification done in three steps in logic blocks 501, 502, and 504, from which the operation of blocks 501 and 502 is well known to those or ordinary skill in the art.

First, a voice activity detector (VAD) 501 discriminates between active and inactive speech frames. If an inactive speech frame is detected, the speech signal is processed according to mode 508.

If an active speech frame is detected in block 501, the frame is subjected to a second classifier 502 dedicated to making a voicing decision. If the classifier 502 rates the current frame as unvoiced speech signal, the classification chain ends and the speech signal is processed in accordance with mode 507. Otherwise, the speech frame is passed through to the signal modification module 603.

The signal modification module then provides itself a decision on enabling or disabling the signal modification of the current frame in a logic block 504. This decision is in practice made as an integral part of the signal modification procedure in the logic blocks 102, 104 and 106 as explained earlier with reference to FIG. 2. When signal modification is enabled, the frame is deemed as a stable voiced, or purely voiced speech segment.

When the rate determination mechanism selects mode 506, the signal modification mode is enabled and the speech frame is encoded in accordance with the teachings of the previous sections. Table 2 discloses the bit allocation used in the illustrative embodiment for the mode 506. Since the frames to be coded in this mode are characteristically very periodic, a substantially lower bit rate suffices for sustaining good subjective quality compared for instance to transition frames. Signal modification allows also efficient coding of the delay information using only nine bits per 20-ms frame saving a considerable proportion of the bit budget for other parameters. Good performance of long term prediction allows to use only 13 bits per 5-ms subframe for the fixed-codebook excitation without sacrificing the subjective speech quality. The fixed-codebook comprises one track with two pulses, both having 64 possible positions.

TABLE 2

Bit allocation in the voiced 6.2-kbps mode for a 20-ms frame comprising four subframes.

| Parameter | Bits/Frame |
|---|---|
| LP Parameters | 34 |
| Pitch Delay | 9 |
| Pitch Filtering | 4 = 1 + 1 + 1 + 1 |
| Gains | 24 = 6 + 6 + 6 + 6 |
| Algebraic Codebook | 52 = 13 + 13 + 13 + 13 |
| Mode Bit | 1 |
| Total | 124 bits = 6.2 kbps |

TABLE 3

Bit allocation in the 12.65-kbps mode in accordance with the AMR-WB standard.

| Parameter | Bits/Frame |
|---|---|
| LP Parameters | 46 |
| Pitch Delay | 30 = 9 + 6 + 9 + 6 |
| Pitch Filtering | 4 = 1 + 1 + 1 + 1 |
| Gains | 24 = 7 + 7 + 7 + 7 |
| Algebraic Codebook | 144 = 36 + 36 + 36 + 36 |
| Mode Bit | 1 |
| Total | 253 bits = 12.65 kbps |

The other coding modes 505, 507 and 508 are implemented following known techniques. Signal modification is disabled in all these modes. Table 3 shows the bit allocation of the mode 505 adopted from the AMR-WB standard.

The technical specifications [11] and [12] related to the AMR-WB standard are enclosed here as references on the comfort noise and VAD functionalities in 501 and 508, respectively.

[11] 3GPP TS 26.192, "AMR Wideband Speech Codec: Comfort Noise Aspects," 3GPP Technical Specification.

[12] 3GPP TS 26.193, "AMR Wideband Speech Codec: Voice Activity Detector (VAD)," 3GPP Technical Specification.

In summary, the present specification has described a frame synchronous signal modification method for purely voiced speech frames, a classification mechanism for detecting frames to be modified, and to use these methods in a source-controlled CELP speech codec in order to enable high-quality coding at a low bit rate.

The signal modification method incorporates a classification mechanism for determining the frames to be modified. This differs from prior signal modification and preprocessing means in operation and in the properties of the modified signal. The classification functionality embedded into the signal modification procedure is used as a part of the rate determination mechanism in a source-controlled CELP speech codec.

Signal modification is done pitch and frame synchronously, that is, adapting one pitch cycle segment at a time in the current frame such that a subsequent speech frame starts in perfect time alignment with the original signal. The pitch cycle segments are limited by frame boundaries. This feature prevents time shift translation over frame boundaries simplifying encoder implementation and reducing a risk of artifacts in the modified speech signal. Since time shift does not accumulate over successive frames, the signal modification method disclosed does not need long buffers for accommodating expanded signals nor a complicated logic for controlling the accumulated time shift. In source-controlled speech coding, it simplifies multi-mode operation between signal modification enabled and disabled modes, since every new frame starts in time alignment with the original signal.

Of course, many other modifications and variations are possible. In view of the above detailed illustrative description of the present invention and associated drawings, such other modifications and variations will now become apparent to those of ordinary skill in the art. It should also be apparent that such other variations may be effected without departing from the spirit and scope of the present invention.

What is claimed is:

1. A method, comprising:

dividing a sound signal into a series of successive flames;

dividing each frame into a number of subframes;

producing, by a device, a residual signal by filtering the sound signal through a linear prediction analysis filter;

locating a last pitch pulse of the sound signal of a previous frame from the residual signal;

extracting a pitch pulse prototype of given length around a position of the last pitch pulse of the previous frame using the residual signal;

locating pitch pulses in a current frame using the pitch pulse prototype;

predicting a position of a first pitch pulse of the current frame to occur at an instant related to the position of the previously located pitch pulse and an interpolated open-loop pitch estimate at an instant corresponding to the position of the previously located pitch pulse; and refining the predicted position of said pitch pulse by maximizing a weighted correlation between the pulse prototype and the residual signal.

2. The method as defined in claim 1, further comprising:

repeating the prediction of pitch pulse position and the refinement of predicted position until said prediction and refinement yields a pitch pulse position located outside the current frame.

3. An apparatus, comprising:

a divider, within a device, configured to divide a sound signal into a series of successive frames;

a divider of each frame into a number of subframes;

a linear prediction analysis filter configured to filter the sound signal and thereby producing a residual signal;

a detector configured to detect a last pitch pulse of the sound signal of a previous frame in response to the residual signal;

an extractor configured to extract a pitch pulse prototype of given length around a position of the last pitch pulse of the previous frame in response to the residual signal;

a detector configured to detect pitch pulses in a current frame using the pitch pulse prototype;

a predictor configured to predict a position of each pitch pulse of the current frame to occur at an instant related to the position of the previous located pitch pulse and an interpolated open-loop pitch estimate at said instant corresponding to the position of the previously located pitch pulse; and a refiner configured to refine the predicted position of said pitch pulse by maximizing a weighted correlation between the pulse prototype and file residual signal.

4. The apparatus as defined in claim 3, further comprising:

a repeater configured to repeat the prediction of pitch pulse position and the refinement of predicted position until said prediction and refinement yields a pitch pulse position located outside the current frame.

5. A method, comprising:

dividing, by a device, a sound signal into a series of successive frames;

dividing each frame into a number of subframes;

producing a weighted sound signal by processing the sound signal through a weighting filter, the weighted sound signal being indicative of signal periodicity;

locating a last pitch pulse of the sound signal of the previous frame from the weighted sound signal;

extracting a pitch pulse prototype of given length around a position of the last pitch pulse of a previous frame using the weighted sound signal;

locating pitch pulses in a current frame using the pitch pulse prototype;

predicting a position of a first pitch pulse of the current frame to occur at an instant related to the position of the previously located pitch pulse and an interpolated open-loop pitch estimate at an instant corresponding to the position of the previously located pitch pulse; and refining the predicted position of said pitch pulse by maximizing a weighted correlation between the pulse prototype and the weighted sound signal.

6. The method as defined in claim 5, further comprising:

repeating the prediction, of pitch pulse position and the refinement of predicted position until said prediction and refinement yields a pitch pulse position located outside the current frame.

7. An apparatus, comprising:

a divider, within a device, configured to divide a sound signal into a series of successive frames;

a divider of each frame into a number of subframes;

a weighting filter configured to process the sound signal to produce a weighted sound signal, the weighted sound signal being indicative of signal periodicity;

a detector configured to detect a last pitch pulse of the sound signal of a previous frame in response to the weighted sound signal;

an extractor configured to extract a pitch pulse prototype of given length around a position of the last pitch pulse of the previous frame in response to the weighted sound signal;

a detector configured to detect pitch pulses in a current frame using the pitch pulse prototype;

a predictor configured to predict a position of each pitch pulse of the current frame to occur at an instant related to the position of the previous located pitch pulse and an interpolated open-loop pitch estimate at said instant corresponding to the position of the previously located pitch pulse; and a refiner configured to refine the predicted position of said pitch pulse by maximizing a weighted correlation between the pulse prototype and the weighted sound signal.

8. The apparatus as defined in claim 7, further comprising:

a repeater configured to repeat the prediction of pitch pulse position and the refinement of predicted position until said prediction and refinement yields a pitch pulse position located outside the current frame.

9. A method, comprising:

dividing, by a device, a sound signal into a series of successive frames;

dividing each frame into a number of subframes;

producing a synthesized weighted sound signal by filtering a synthesized speech signal produced during a last subframe of a previous frame of the sound signal through a weighting filter;

locating a last pitch pulse of the sound signal of the previous frame from the synthesized weighted sound signal;

extracting a pitch pulse prototype of given length around the position of the last pitch pulse of the previous frame using the synthesized weighted sound signal;

locating pitch pulses in a current frame using the pitch pulse prototype;

predicting a position of a first pitch pulse of the current frame to occur at an instant related to the position of the previously located pitch pulse and an interpolated open-loop pitch estimate at an instant corresponding to the position of the previously located pitch pulse; and refining the predicted position of said pitch pulse by maximizing a weighted correlation between the pulse prototype and the synthesized weighted sound signal.

10. The method as defined in claim 9, further comprising:

repeating the prediction of pitch pulse position and the refinement of predicted position until said prediction and refinement yields a pitch pulse position located outside the current frame.

11. An apparatus, comprising:

a divider, within a device, configured to divide a sound signal into a series of successive frames;

a divider configured to divide each frame into a number of subframes;

a weighting filter configured to filter a synthesized speech signal produced during a last subframe of a previous frame of the sound signal and thereby producing a synthesized weighted sound signal;

a detector configured to detect a last pitch pulse of the sound signal of the previous frame in response to the synthesized weighted sound signal;

an extractor configured to extract a pitch pulse prototype of given length around the position of the last pitch pulse of the previous frame in response to the synthesized weighted sound signal;

a detector configured to detect pitch pulses in a current frame using the pitch pulse prototype;

a predictor configured to predict a position of each pitch pulse of the current frame to occur at an instant related to the position of the previous located pitch pulse and an interpolated open-loop pitch estimate at said instant corresponding to the position of the previously located pitch pulse; and a refiner configured to refine the predicted position of said pitch pulse by maximizing a weighted correlation between the pulse prototype and the synthesized weighted sound signal.

12. The apparatus as defined in claim 11, further comprising:

a repeater configured to repeat the prediction of pitch pulse position and the refinement of predicted position until said prediction and refinement yields a pitch pulse position located outside the current frame.

* * * * *